US006769369B1

(12) United States Patent
Brandenberg

(10) Patent No.: US 6,769,369 B1
(45) Date of Patent: Aug. 3, 2004

(54) MODULAR FURNITURE SYSTEM

(76) Inventor: Carl Brock Brandenberg, 5800 Monroe Hwy., Cresson, TX (US) 76035

( * ) Notice: Subject to any disclaimer, the term of this patent is extended or adjusted under 35 U.S.C. 154(b) by 0 days.

(21) Appl. No.: 09/753,799

(22) Filed: Jan. 2, 2001

Related U.S. Application Data

(60) Provisional application No. 60/173,960, filed on Dec. 30, 1999.

(51) Int. Cl.[7] ..... A47B 47/00
(52) U.S. Cl. ..... 108/158.12; 312/257.1
(58) Field of Search ..... 312/108, 195, 312/257.1, 265.5, 263; 108/50.01, 158.12

(56) References Cited

U.S. PATENT DOCUMENTS 2,334,912 A * 11/1943 Eide ..... 108/158.12 X
2,926,978 A * 3/1960 Mitchell ..... 312/108 X
3,069,216 A * 12/1962 Vaeth ..... 108/158.12 X
4,055,924 A * 11/1977 Beaver, Jr. ..... 312/265.5 X
4,153,311 A * 5/1979 Takahashi ..... 312/195 X
5,816,980 A 10/1998 Myszka et al.
6,283,564 B1 * 9/2001 Corson ..... 312/195 X

* cited by examiner

*Primary Examiner*—Thomas A. Dixon
*Assistant Examiner*—Michael J. Fisher
(74) *Attorney, Agent, or Firm*—Melvin A. Hunn

(57) ABSTRACT

A modular furniture system having planar vertical components having slots and tabs, and planar horizontal components having slots and tabs, wherein the vertical components and the horizontal components releasably and interlockingly mate with each other to form a plurality of different pieces of furniture.

16 Claims, 44 Drawing Sheets

MODULAR FURNITURE SYSTEM

This application claims the benefit of U.S. Provisional Application No. 60/173,960, filed Dec. 30, 1999, titled "Modular Desk System."

BACKGROUND ART

1. Field of the Invention

The present invention relates to modular furniture. In particular, the present invention relates to interlocking modular furniture.

2. Description of Related Art

The internet has caused an incredible growth in the number of new businesses established to take advantage of products and services that can be sold and distributed over the internet. These businesses typically begin as small, private businesses that require but cannot afford the overhead that an already established, profitable company can. Nevertheless, these new businesses still have many of the same office needs as established companies, including suitable office furniture for employees.

The internet has also allowed many established businesses to change their working environments and allow employees to work from home in what is generally known as telecommuting. In telecommuting, employees work from home using the internet to access all the information and services required to complete their work. Telecommuting has helped companies reduce the size of their offices, but it has only transferred the responsibility of outfitting the employee's home office with suitable furniture to the employee.

In both the small company and the home office environment, there is a desire for cost-effective office furniture that is both functional and stylish. In the small, start-up company, the emphasis is on unique style and functionality. In the home office environment, the emphasis is on comfort and matching an existing decor. In the small company, there is usually no one responsible for facility management, and the burden lies on a subset of the employees to choose, purchase, configure, assemble, and maintain the office furniture. In the home, it is the responsibility of the employee to perform these tasks. As a result, the furniture selected must be easy to configure, assemble, and maintain, in addition to being stylish, functional, and affordable.

Office furniture can be categorized into two basic categories—casegoods and modular systems. Casegoods are freestanding furniture components typically found in offices that have individual rooms for employees, and they usually include complete desks, filing systems, and shelf units. Casegoods lack modularity and are simply separate furniture components that are set beside one another. For this reason, casegoods typically lack the style that small companies desire. Casegoods usually come pre-assembled because of their complex design, and are typically too large for the home environment, in that casegoods are not designed to fit through narrower doorways and into the smaller spaces typically found in the home. Although some small, inexpensive components are available through local office supplies from manufacturers such as O'Sullivan and Rubbermaid, their styling is typically very dull, and their quality is low, being manufactured from laminated particle board, sheet metal, and blow-molded plastic. Furthermore, although some stylish and more attractive components are available from manufacturers, such as the Beirise Collection, the TJ Collection from Herman Miller, Docker and Roadworks from Steelcase, and Tripoli and Varia from Haworth, these components are extremely expensive, and are typically purchased only by very profitable companies or individuals.

On the other hand, modular systems consist of components that can be configured and assembled for a particular office environment, then disassembled, reconfigured and reassembled to satisfy changing needs. Components of modular systems include vertical support panels, work surfaces, shelving, and storage systems, that can be assembled in many different configurations. Modular systems are designed for large office spaces that will be broken up by the furniture itself which is typically configured to form individual cubicles for employees. Thus, modular systems are not well suited for small office spaces or a home environment where they do not integrate well with existing decor. Such modular systems also require a certain level of expertise to configure and assemble them. Modular systems are engineered to have a very long service life and are very expensive, out of the reach of all but the most profitable companies. Although modular systems can be purchased as used or reconditioned, this market is small, and there are few retail outlets where a buyer can go and shop to find used furniture in good condition. These modular systems include such systems as Action Office and Ethospace from Merna Miller, Context and Series 9000 from Steelcase, and Causeway and Unigroup from Haworth. There are less expensive lines of furniture available, but the quality of the furniture is typically low, because the manufacturers strive to provide all the features of the more expensive systems at a much lower cost, but cannot do so without reducing the quality of manufacture. As a result, existing modular systems are neither cost effective nor appropriate for small office or home use.

As a result neither existing casegoods nor existing modular furniture systems provide cost-effective, functional, and stylish furniture that can be configured and assembled by persons without a certain level of expertise in facility management or in assembling such furniture.

BRIEF SUMMARY OF THE INVENTION

There is a need for a modular furniture system that can be manufactured entirely from planar material of uniform thickness, that can be assembled without tools or fasteners, that is reversible, that can be re-configured into different pieces of furniture, and that requires no level of expertise to assemble.

Therefore, it is an object of the present invention to provide a modular furniture system that can be manufactured entirely from planar material of uniform thickness, that can be assembled without tools or fasteners, that is reversible, and that can be re-configured into different pieces of furniture.

The above objects are achieved by providing a modular furniture system in which the components of the furniture are made from planar material and have uniform thickness. Each component is finished on both sides so that each component is reversible. The components have interlocking tabs, slots, and grooves, which allow the components to be interchanged to form different types of furniture, such as tables, desks, desk returns, desk extensions, desk bridges, hutches, bookshelves, end tables, and others. Because the components are connected together by interlocking tabs, slots, and grooves, no fasteners, glue, or adhesive is required to assemble, disassemble, or re-configure the furniture.

The present invention has significant advantages, including the following:

1. All component pieces are planar in design;
2. Each individual component may be fabricated entirely from planar material of uniform thickness;
3. All components, including work surfaces and vertical supports, are reversible;
4. Each type of furniture can be assembled without tools; and 5. Both symmetrical and asymmetrical furniture designs are possible.

The above objects and advantages, as well as others, will be evident from the following detailed description and drawings of the present invention.

DETAILED DESCRIPTION OF THE PREFERRED EMBODIMENT

Figure 1:
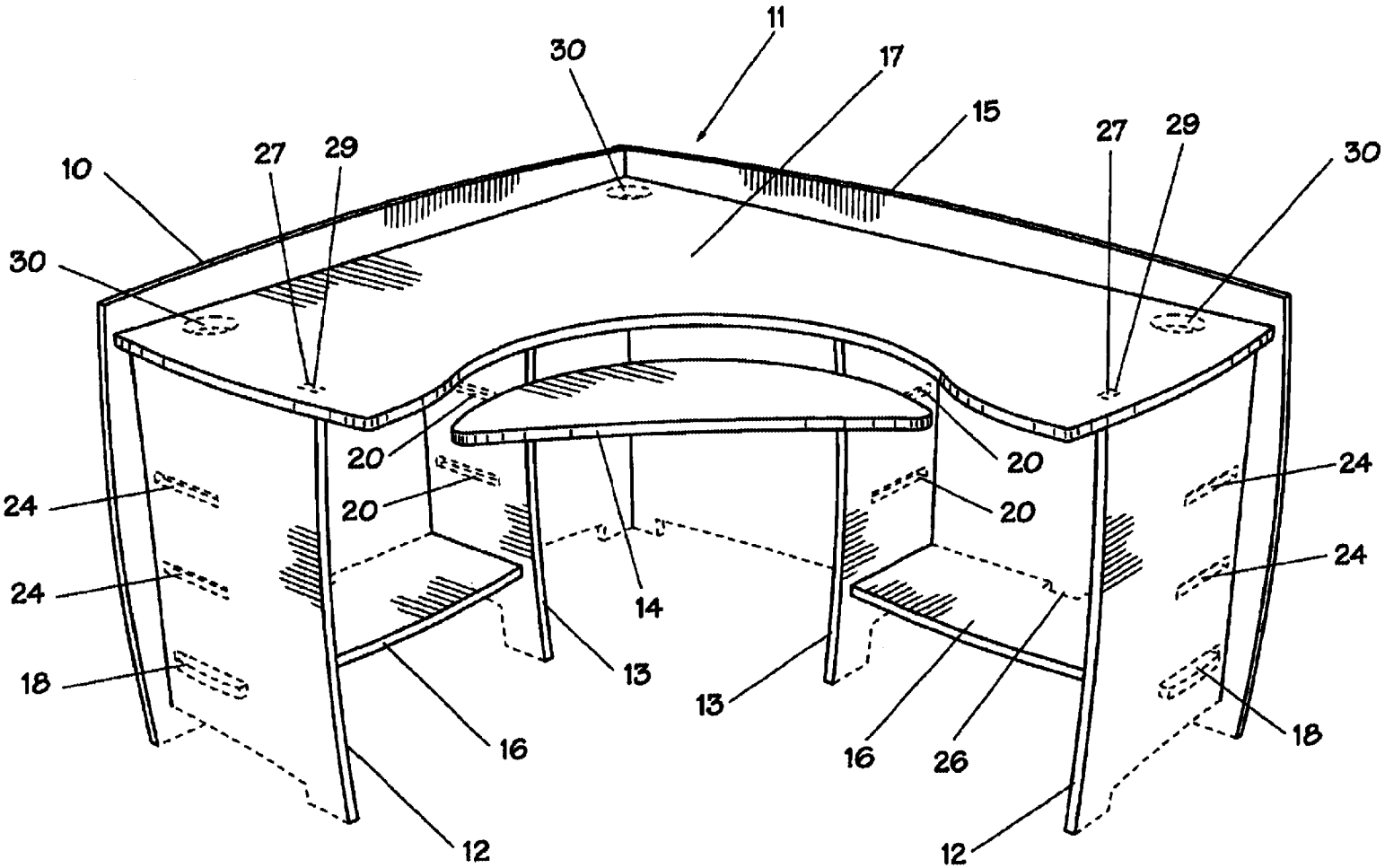
FIG. 1 is a front perspective view of a corner desk according to the present invention.
Figure 2:
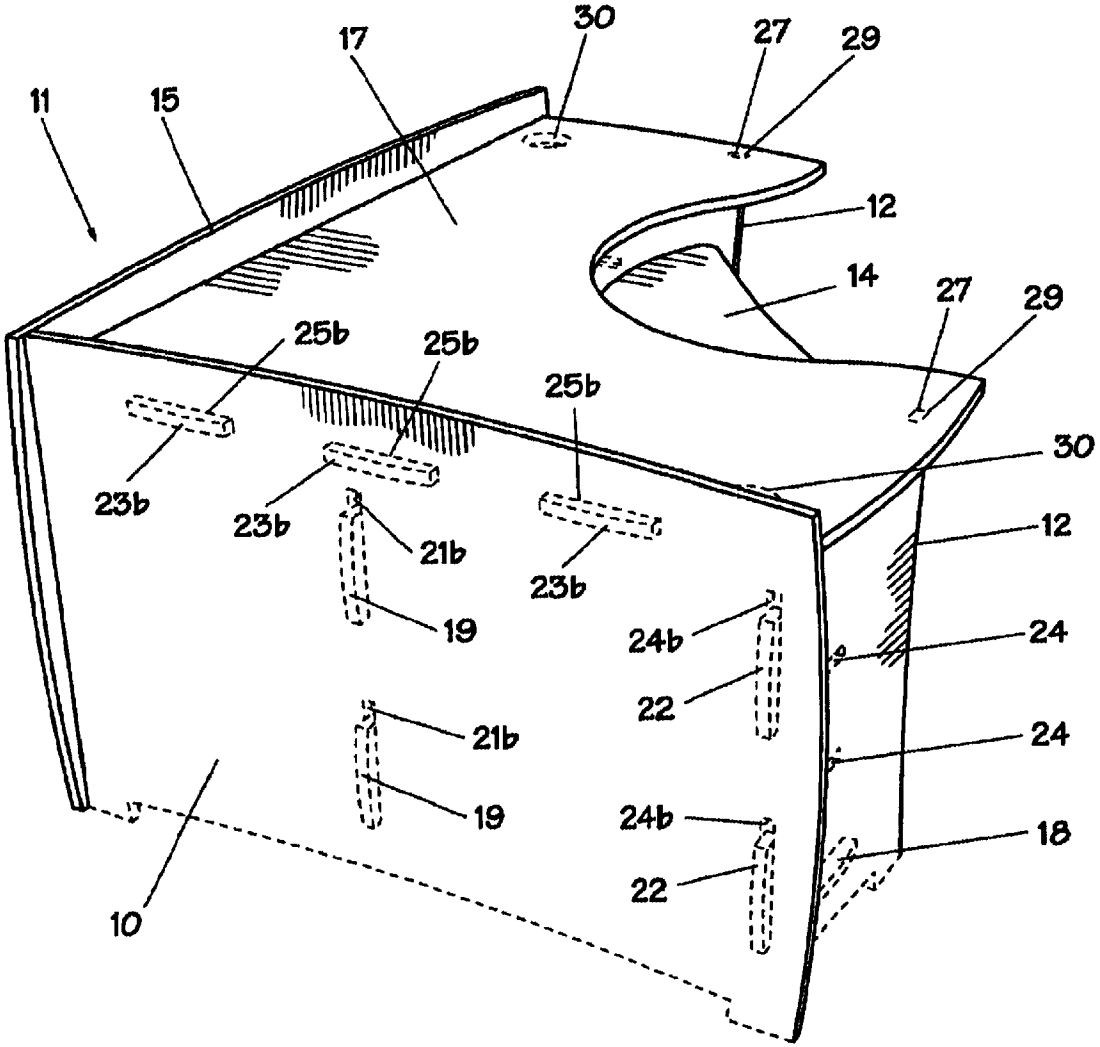
FIG. 2 is a left-side rear perspective view of the desk of FIG. 1.
Figure 3:
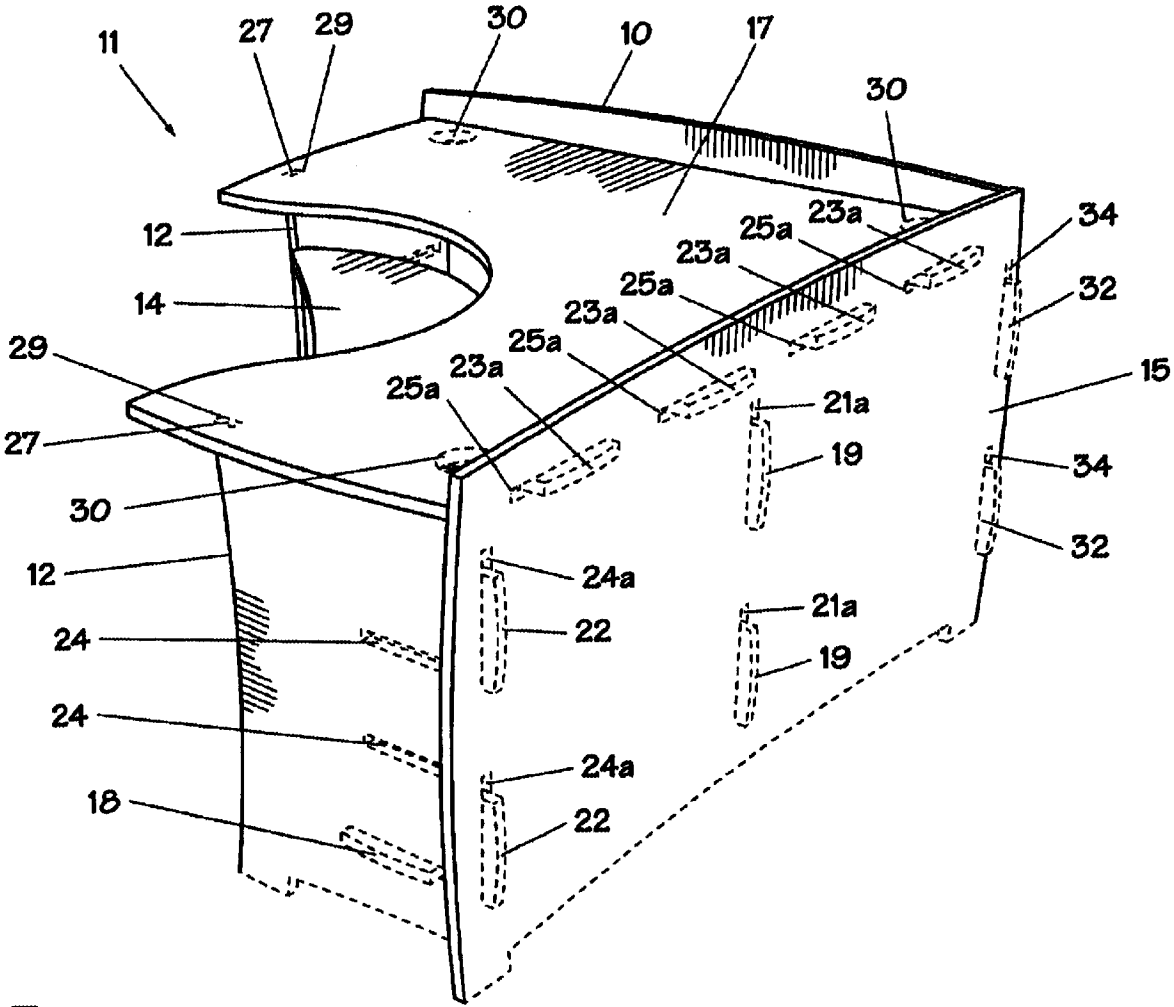
FIG. 3 is a right-side rear perspective view of the desk of FIG. 1.
Figure 4:
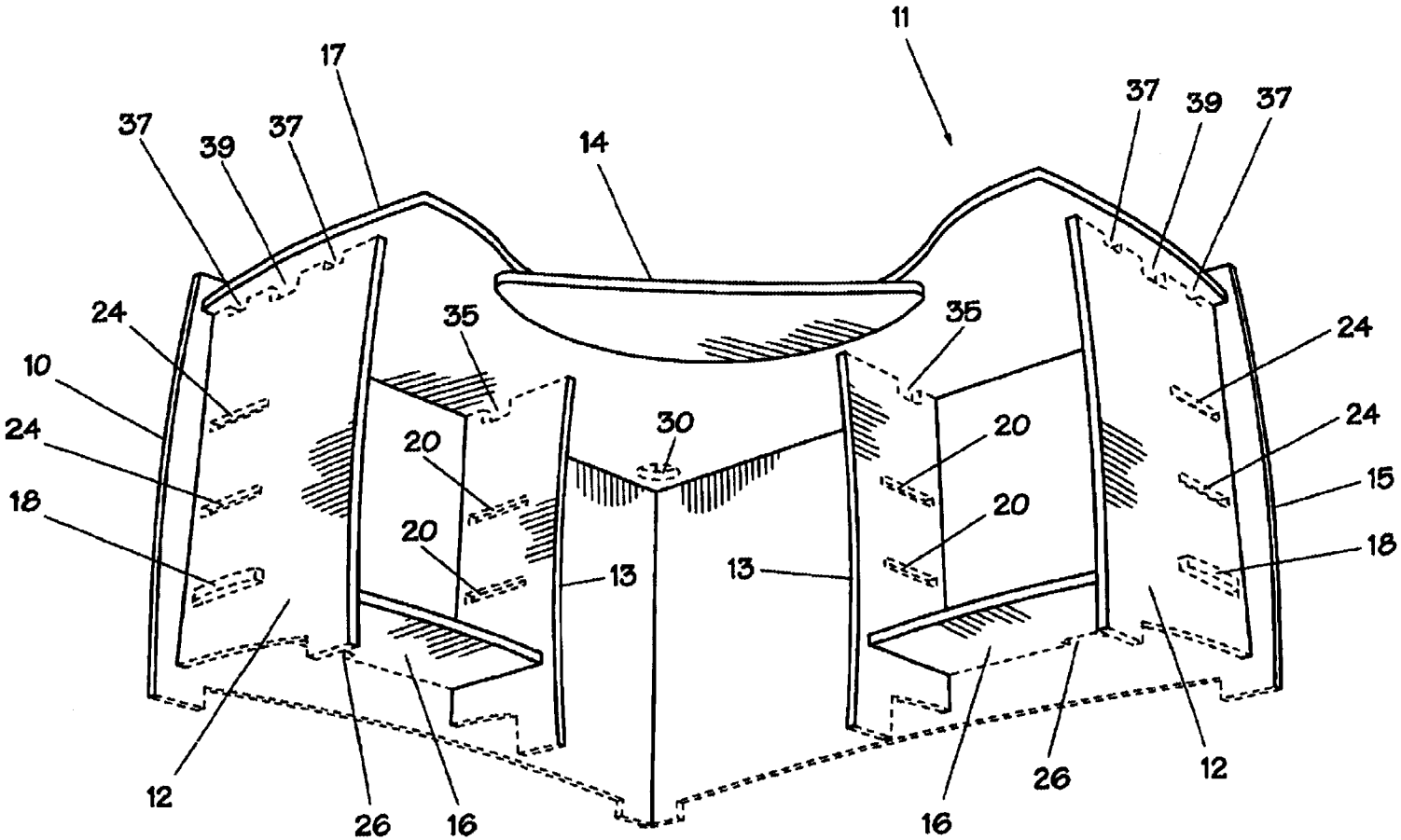
FIG. 4 is a bottom perspective view of the desk of FIG. 1.
Figure 5:
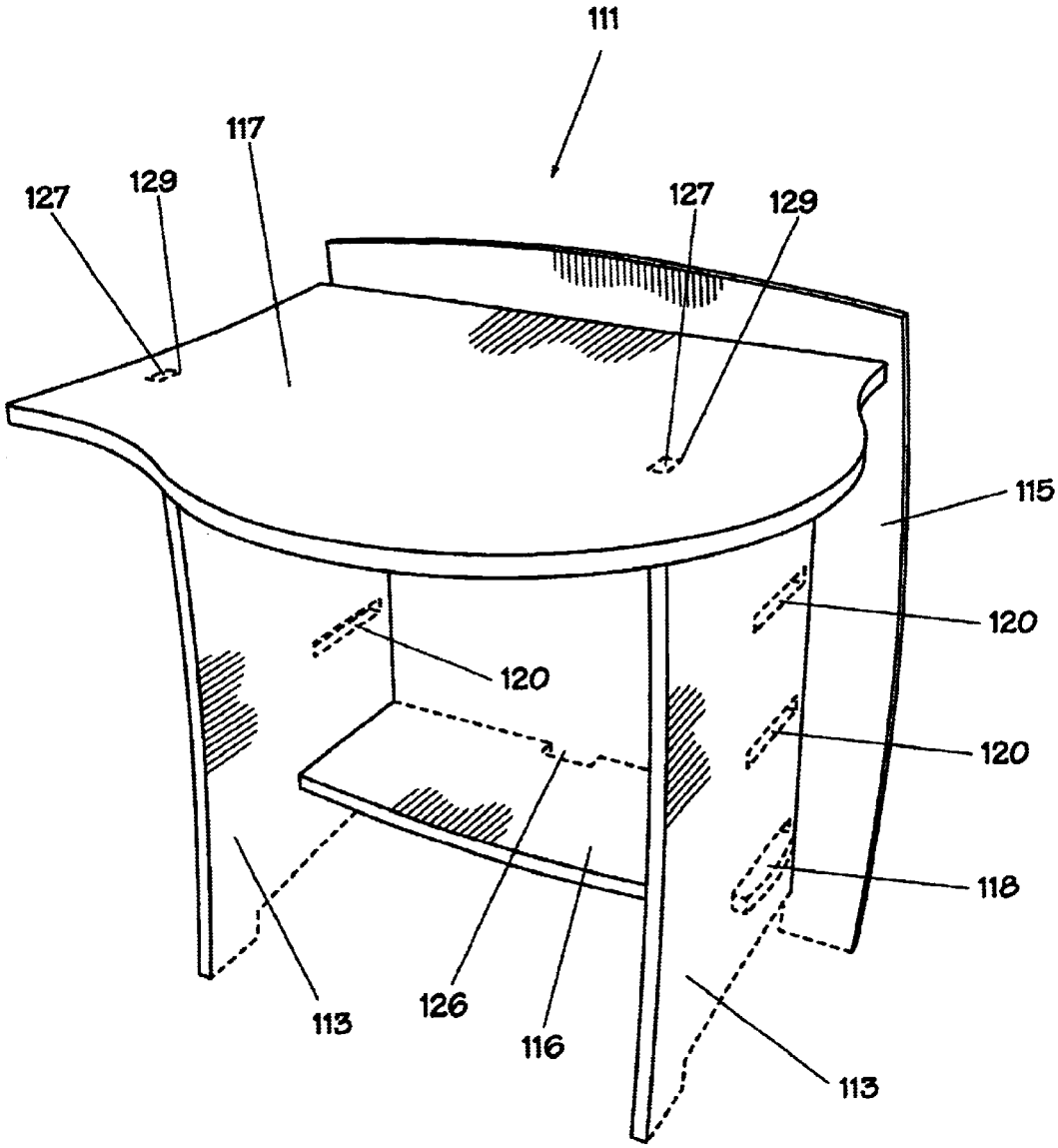
FIG. 5 is a right-side front perspective view of a desk extension according to the present invention.
Figure 6:
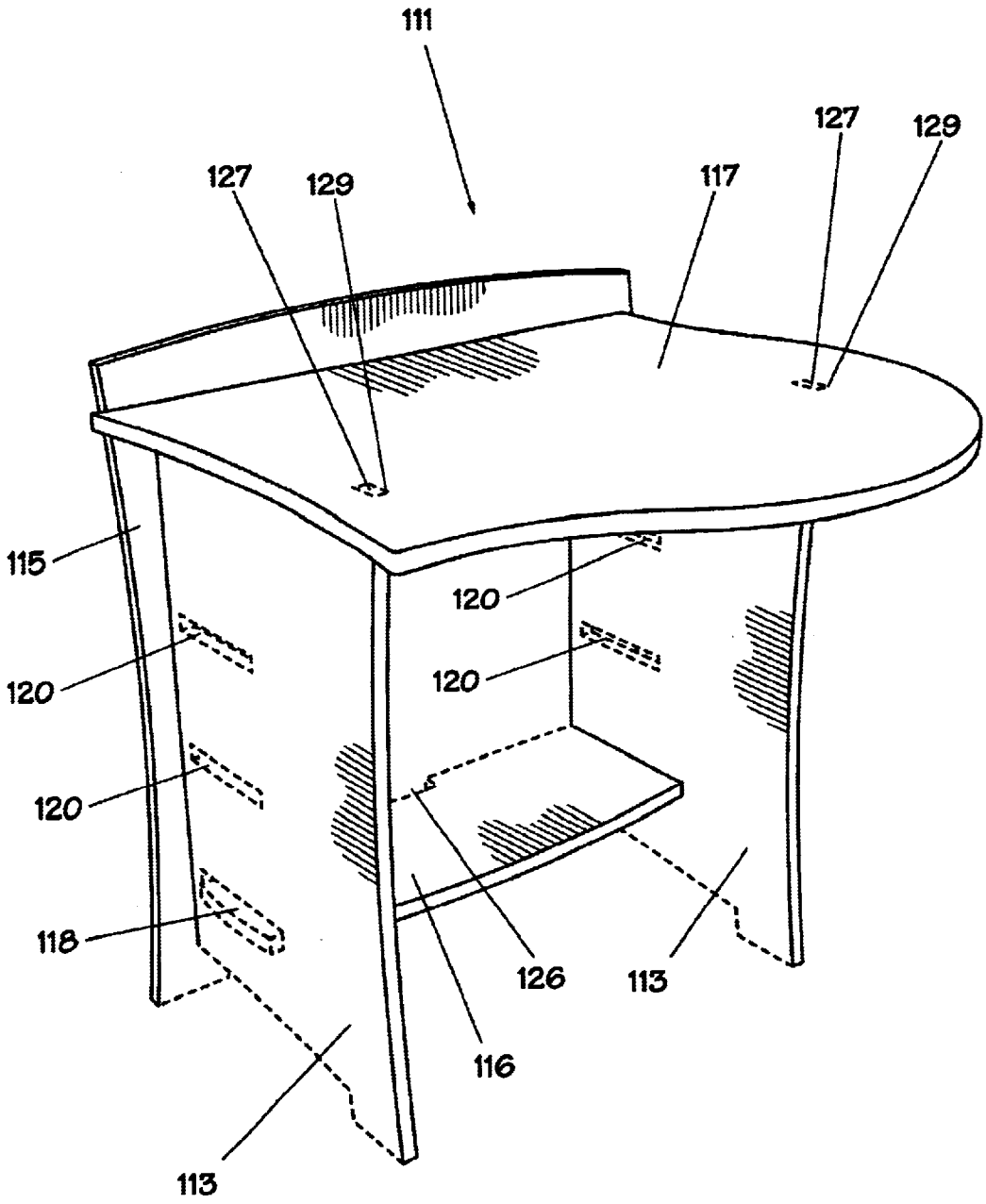
FIG. 6 is a left-side front perspective view of the desk extension of FIG. 5.
Figure 7:
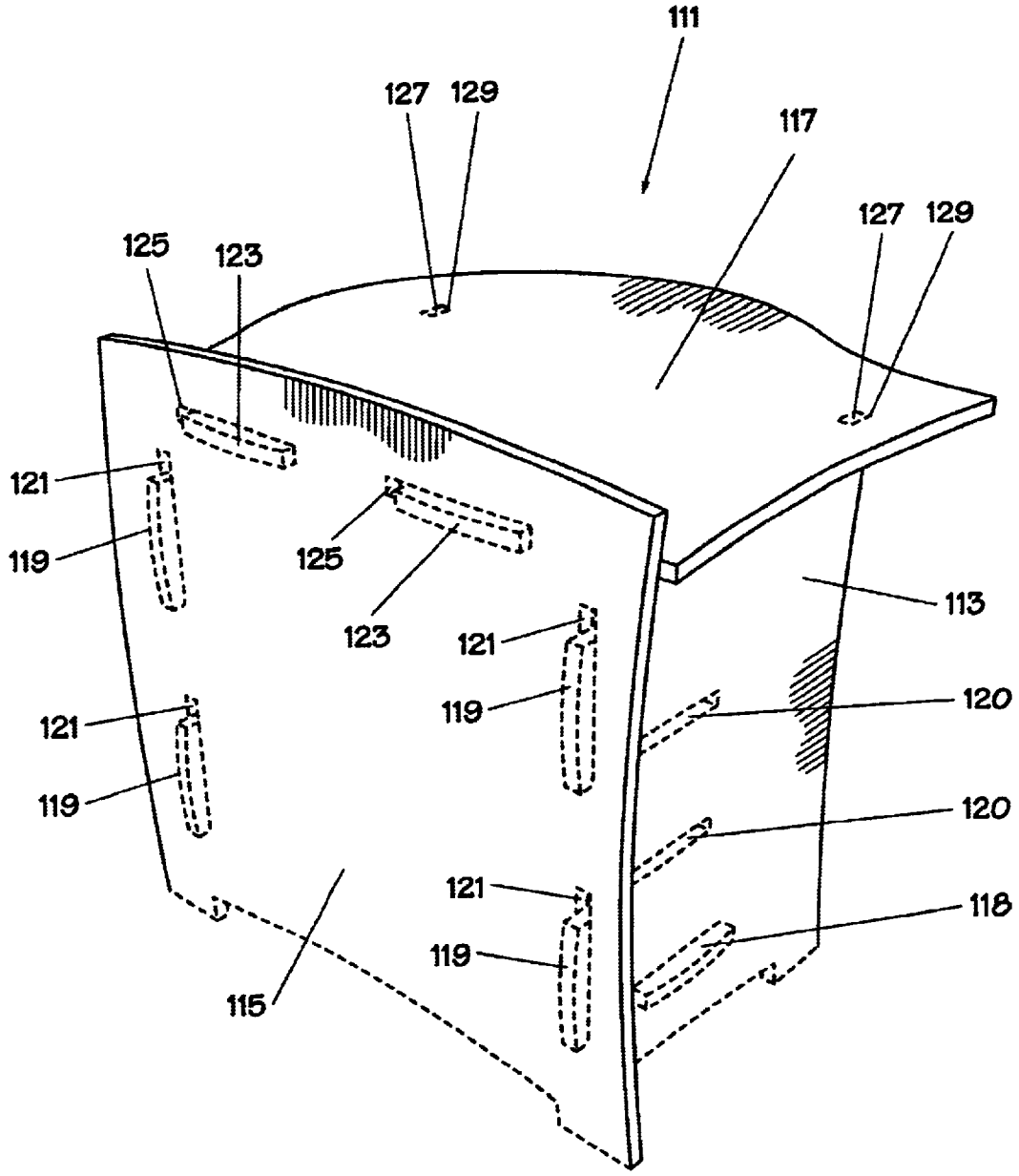
FIG. 7 is a left-side rear perspective view of the desk extension of FIG. 5.
Figure 8:
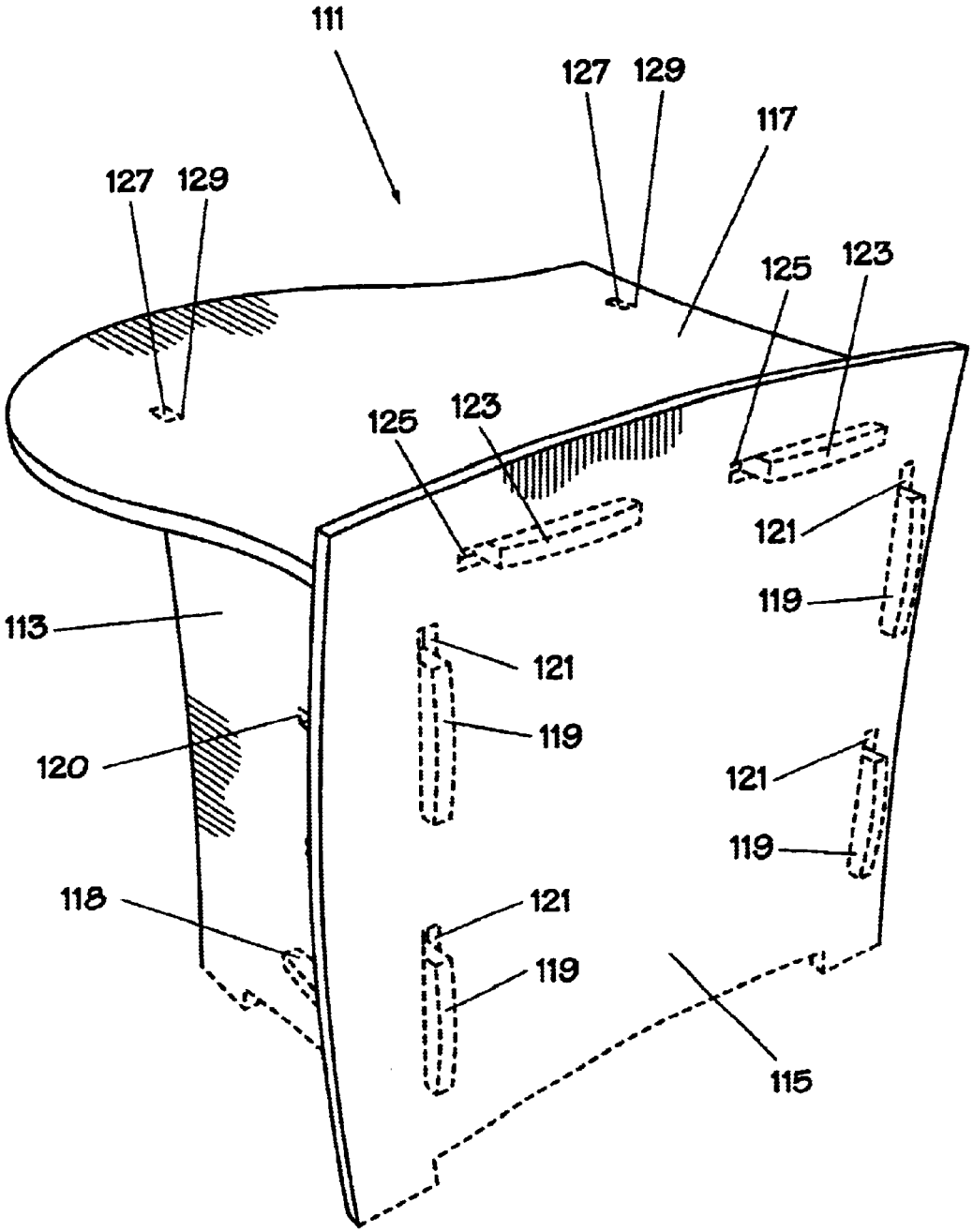
FIG. 8 is a right-side rear perspective view of the desk extension of FIG. 5.
Figure 9:
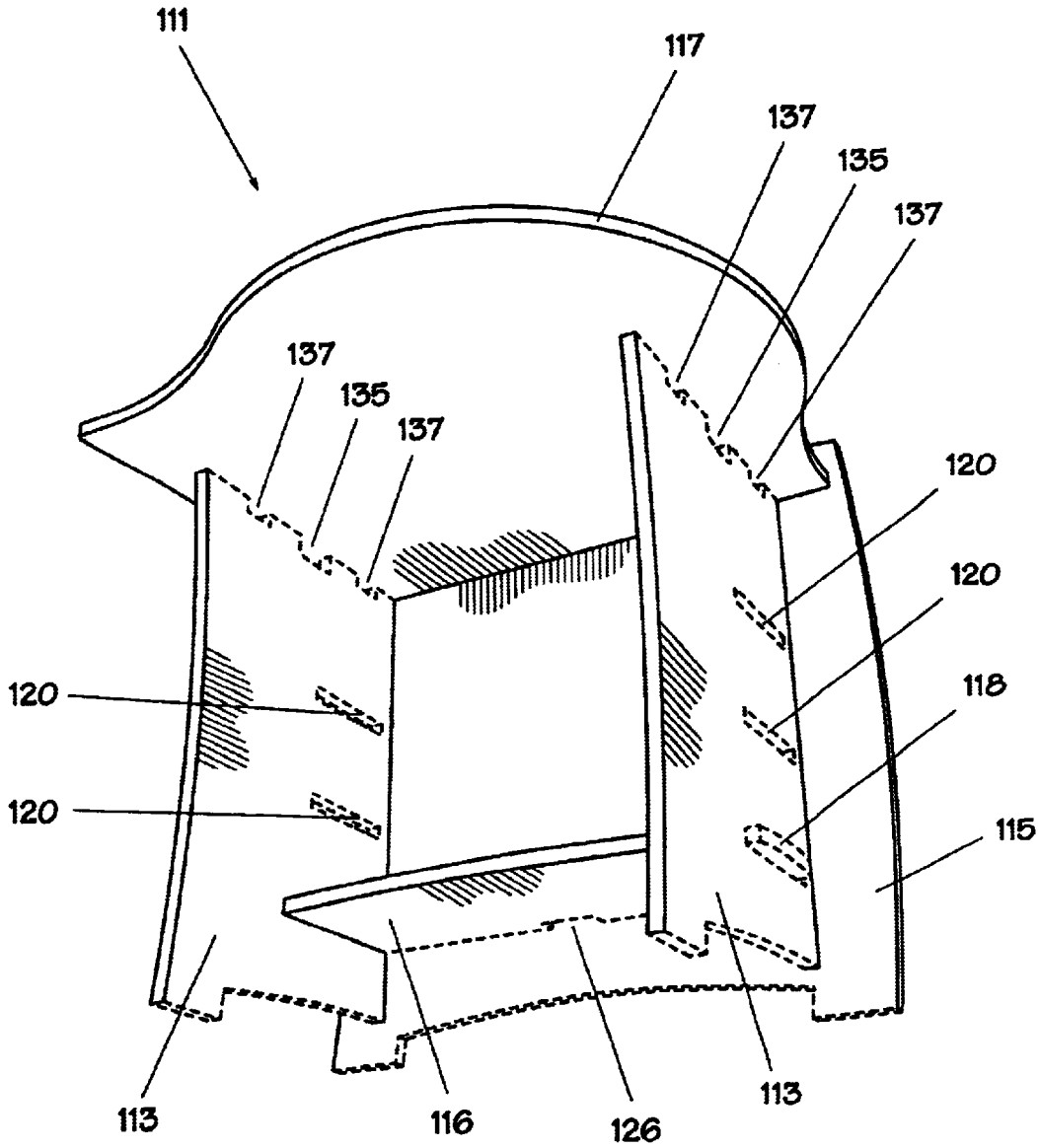
FIG. 9 is a right-side bottom perspective view of the desk extension of FIG. 5.
Figure 10:
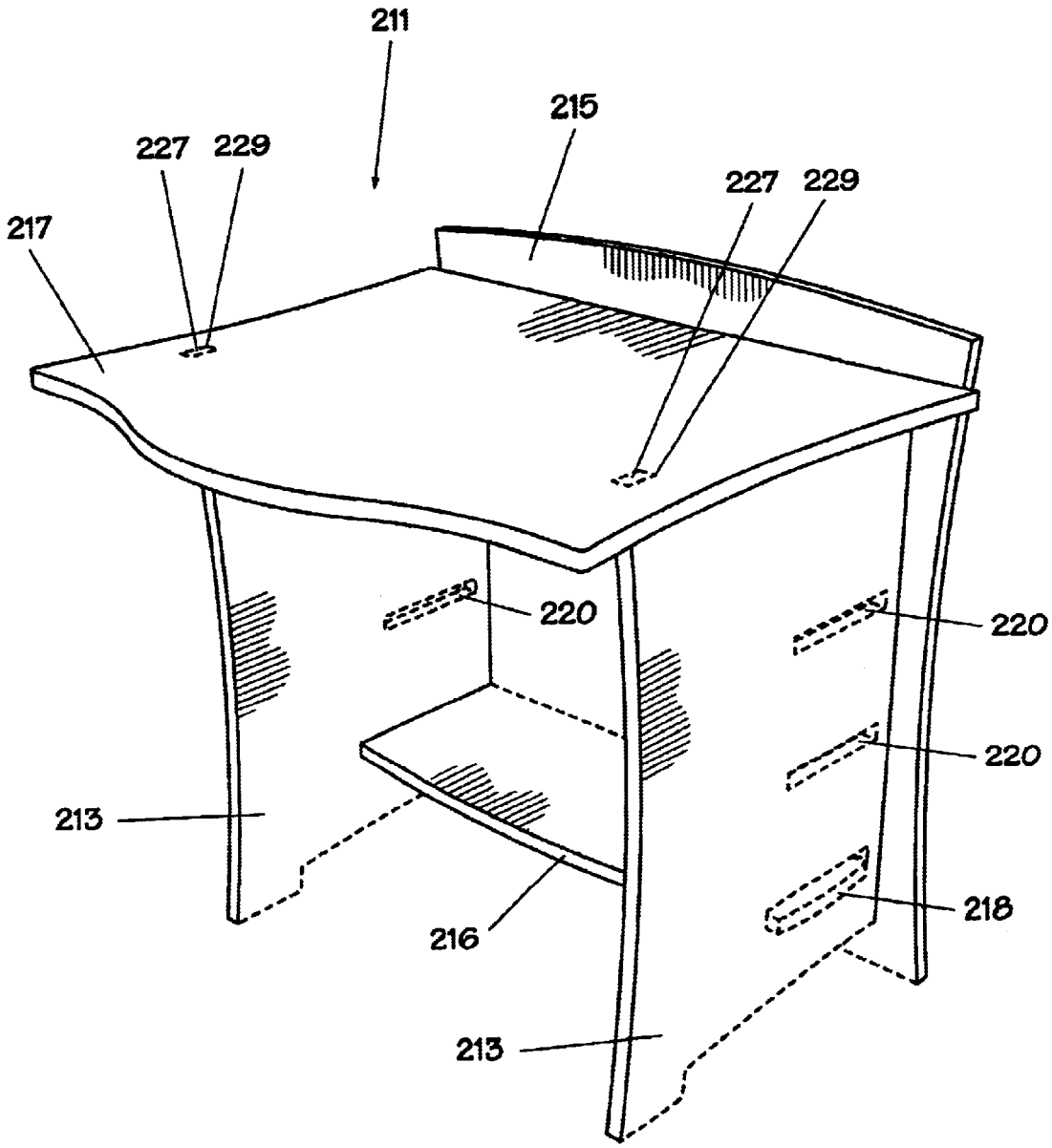
FIG. 10 is a right-side front perspective view of a desk bridge according to the present invention.
Figure 11:
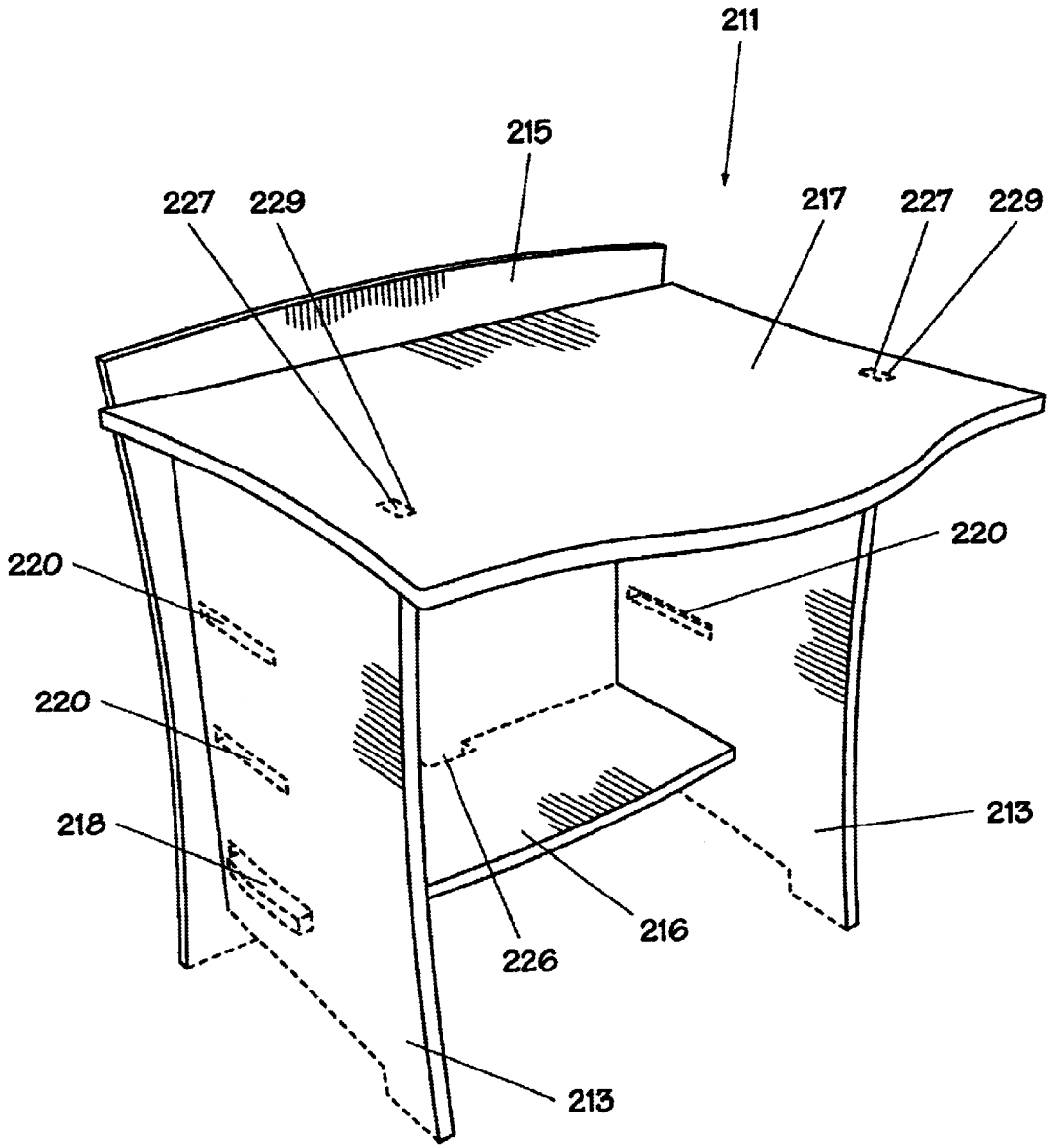
FIG. 11 is a left-side front perspective view of the desk bridge of FIG. 10.
Figure 12:
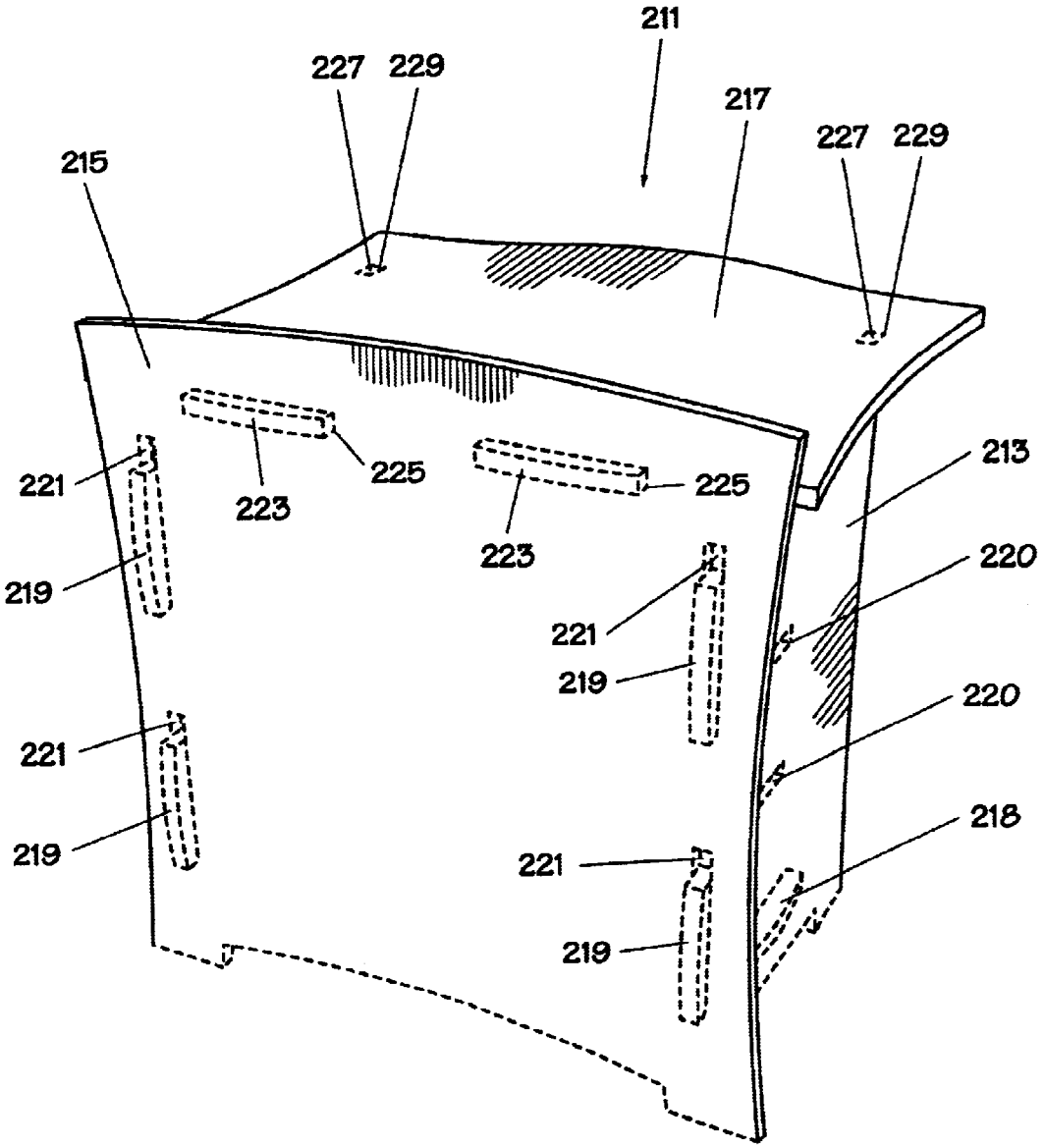
FIG. 12 is a left-side rear perspective view of the desk bridge of FIG. 10.
Figure 13:
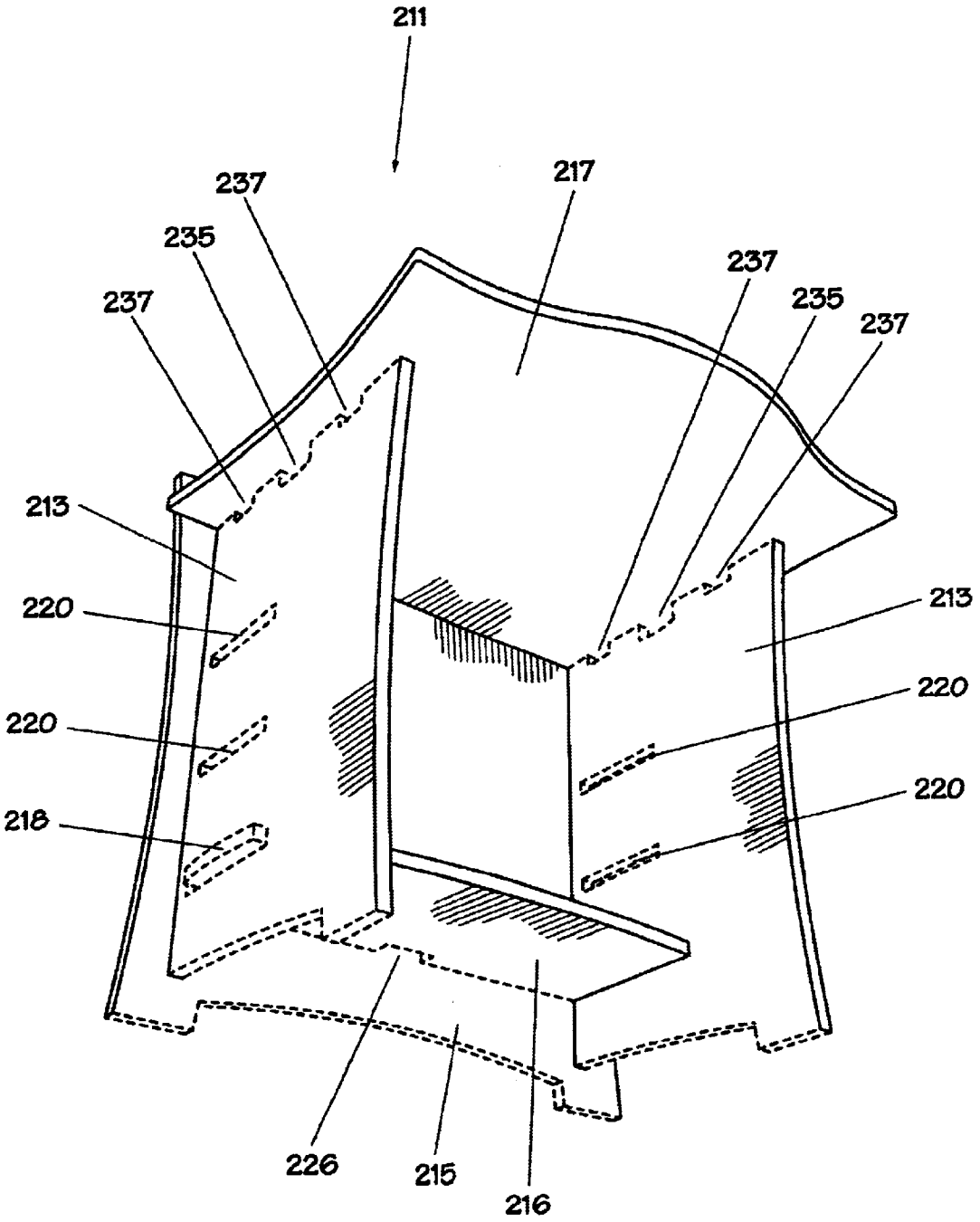
FIG. 13 is a left-side bottom perspective view of the desk bridge of FIG. 10.
Figure 14:
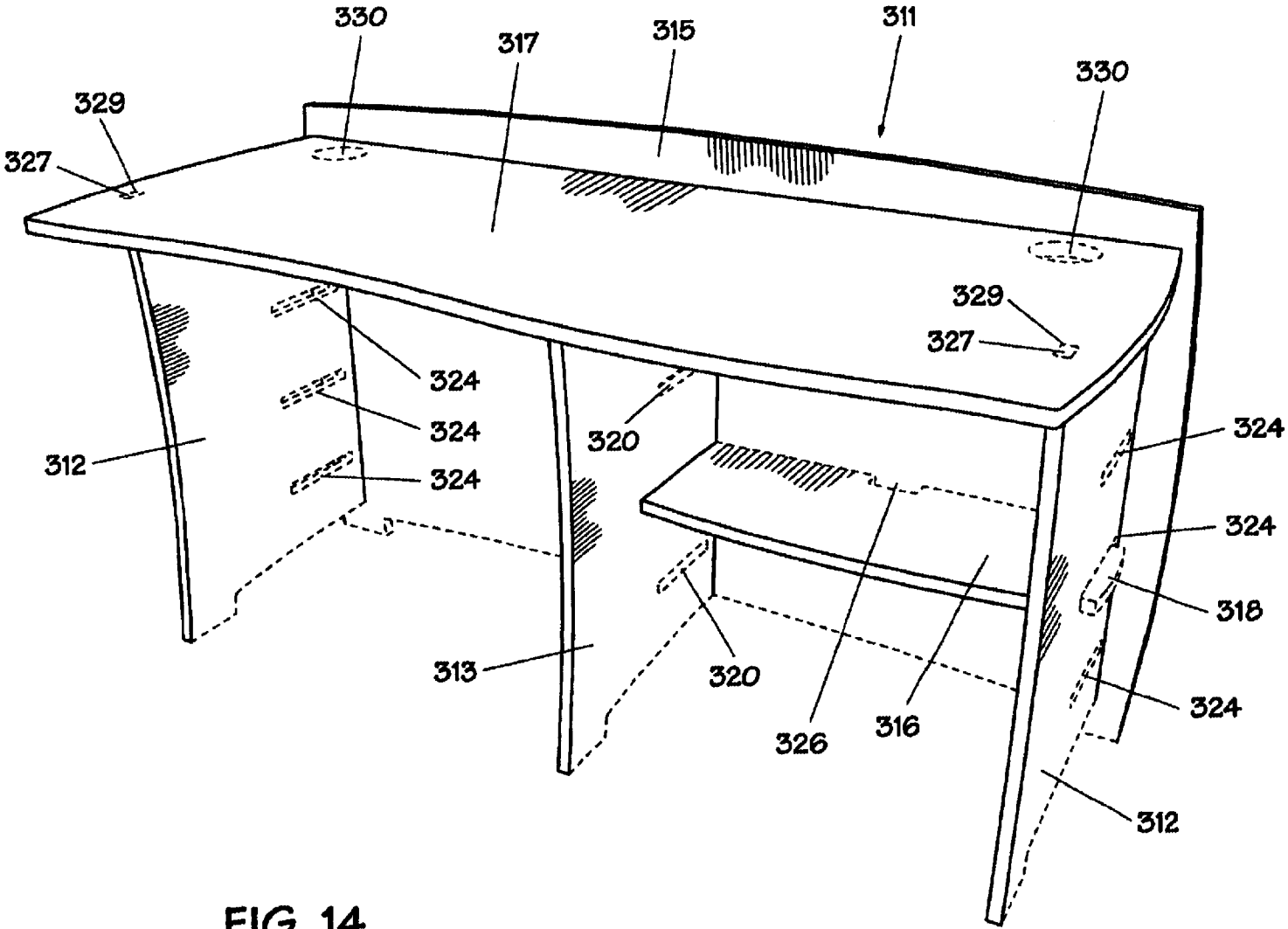
FIG. 14 is a right-side front perspective view of a rectangular desk according to the present invention.
Figure 15:
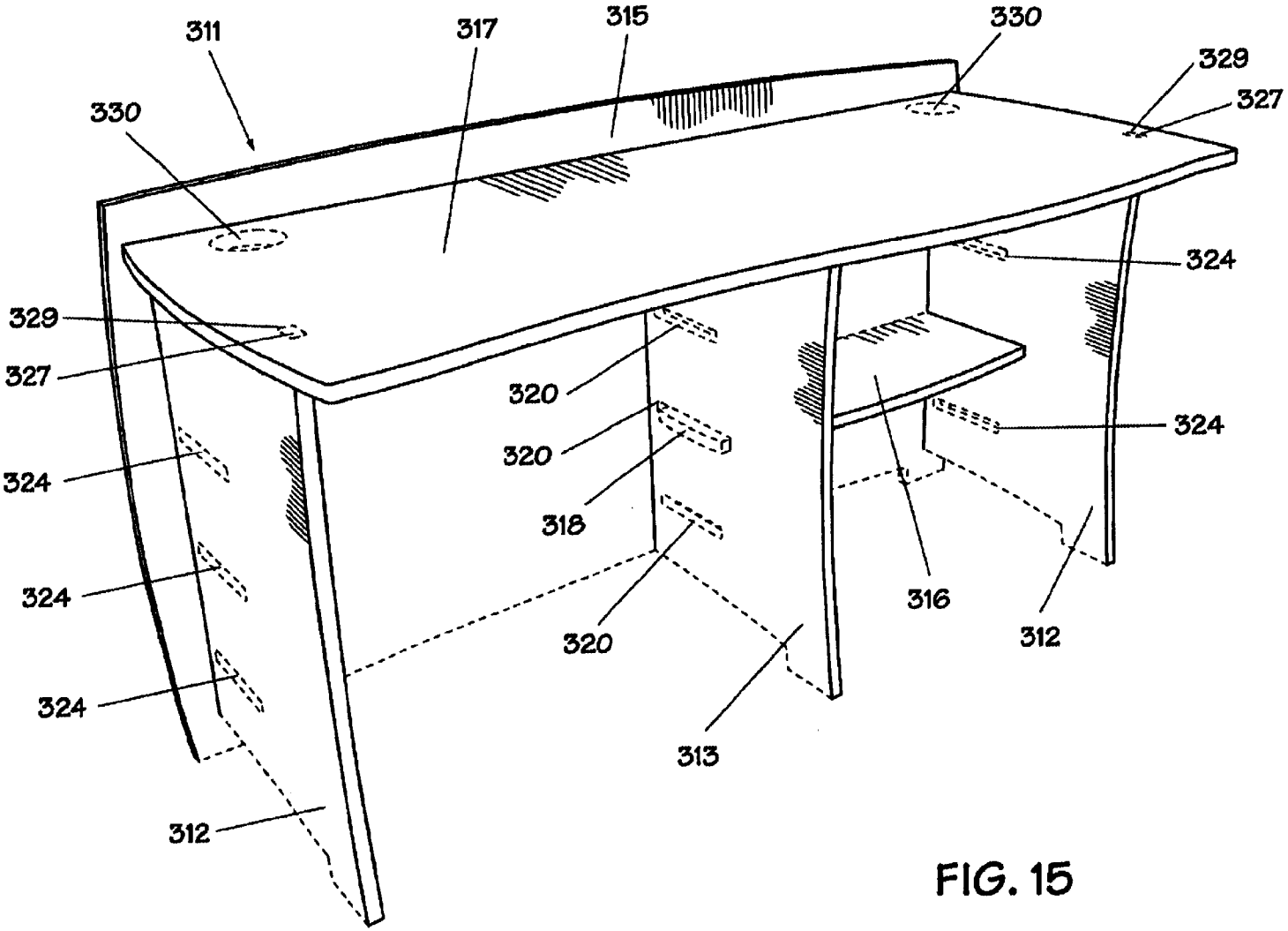
FIG. 15 is a left-side front perspective view of the desk of FIG. 14.
Figure 16:
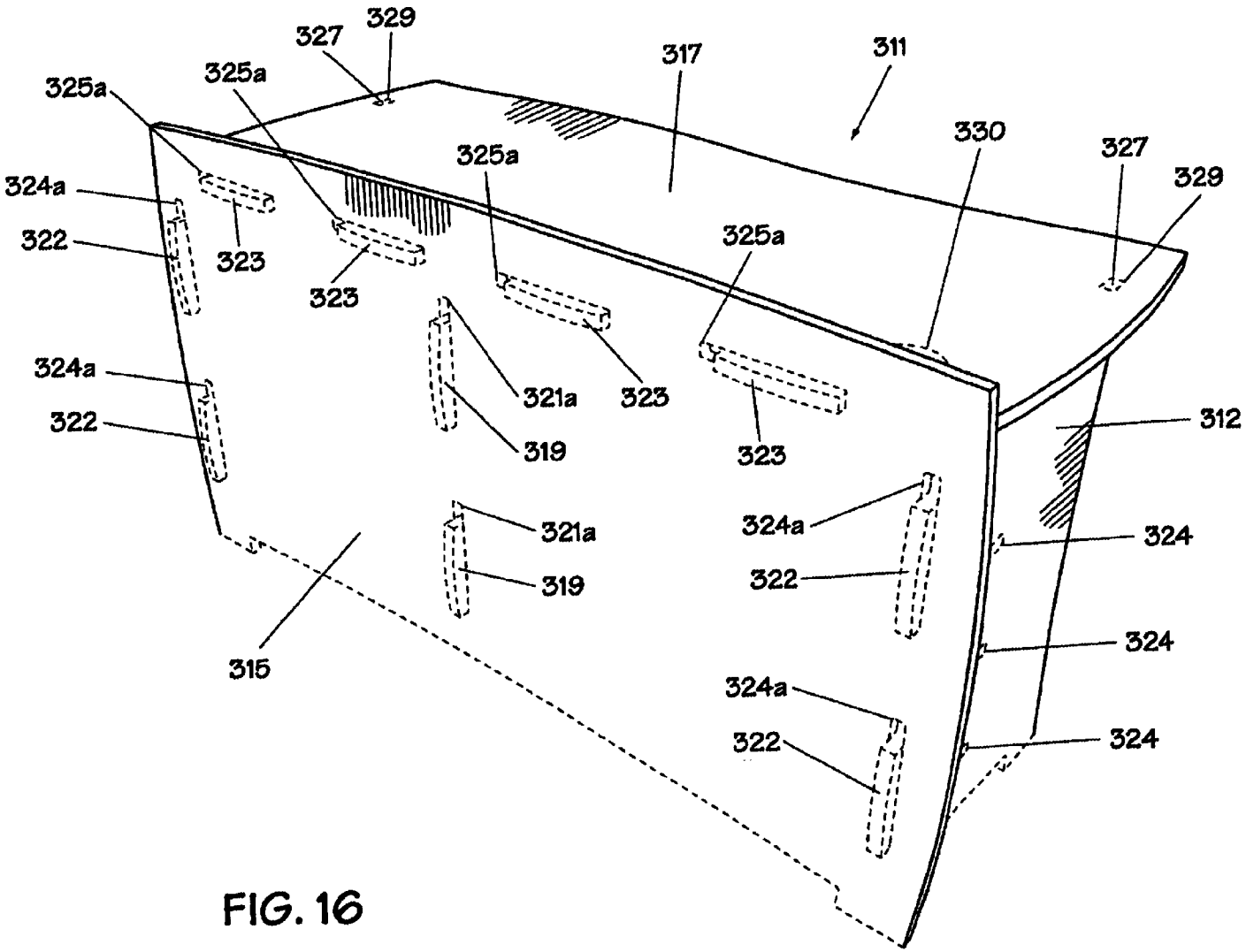
FIG. 16 is a left-side rear perspective view of the desk of FIG. 14.
Figure 17:
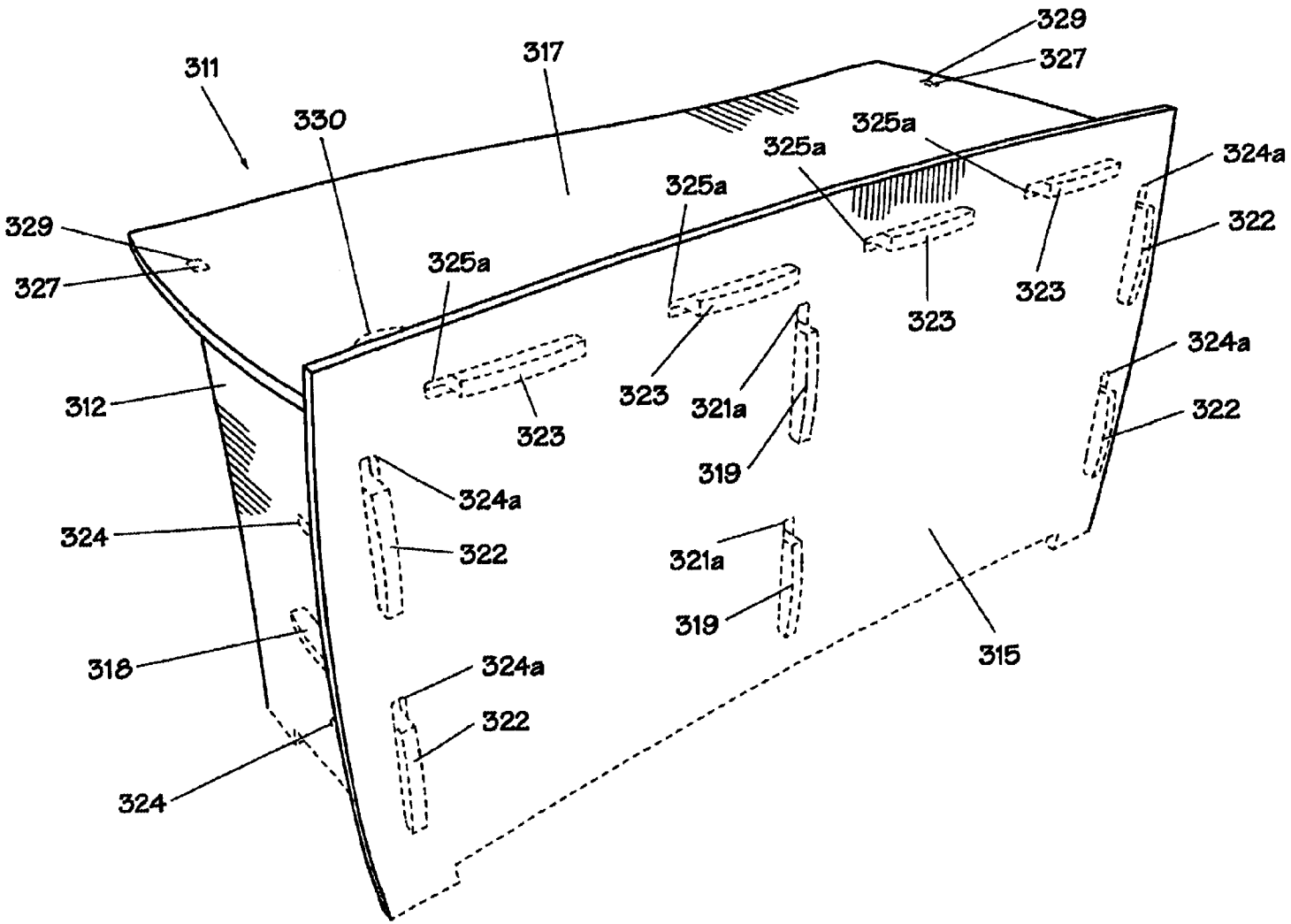
FIG. 17 is a right-side rear perspective view of the desk of FIG. 14.
Figure 18:
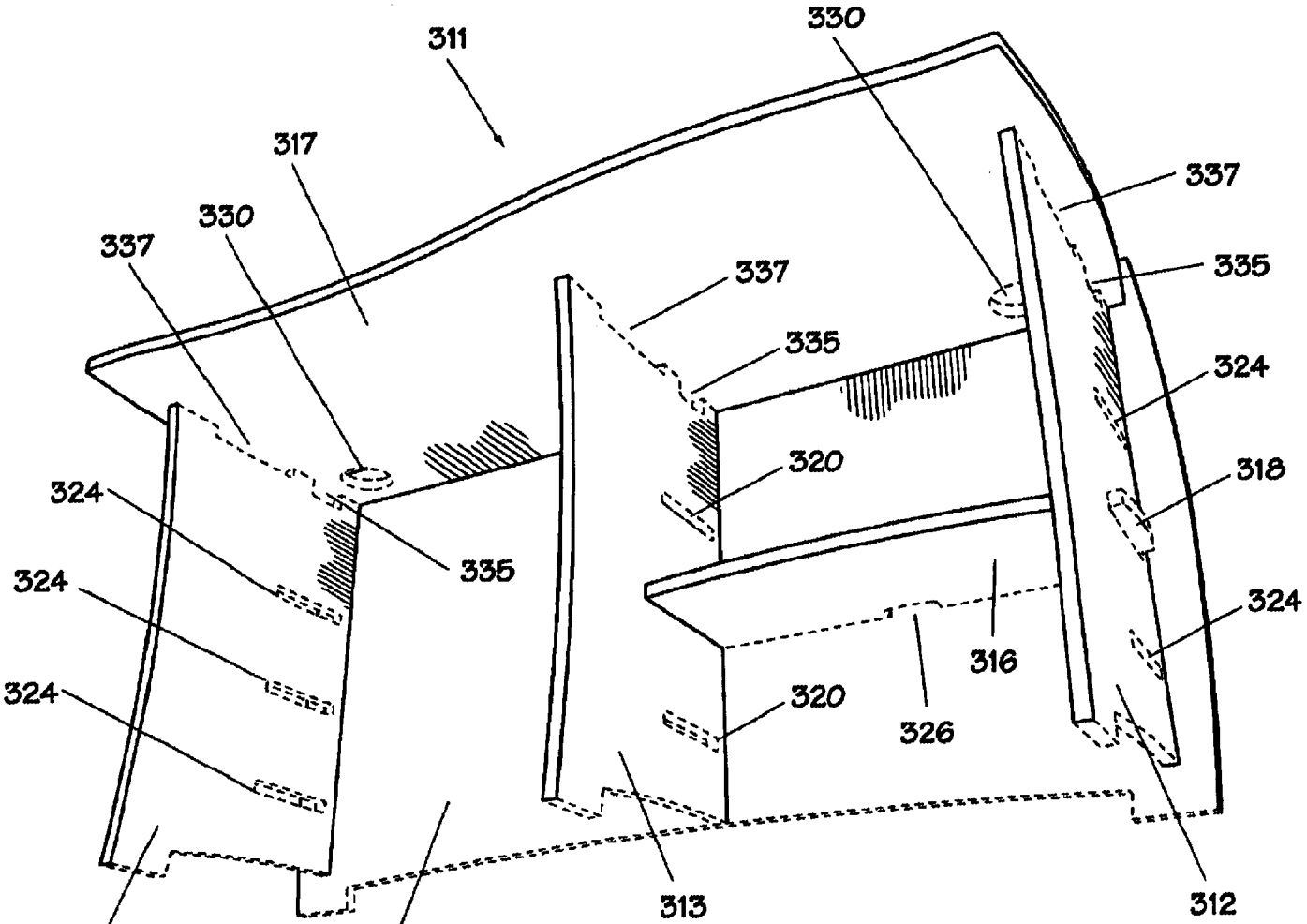
FIG. 18 is a bottom front perspective view of the desk of FIG. 14.
Figure 19:
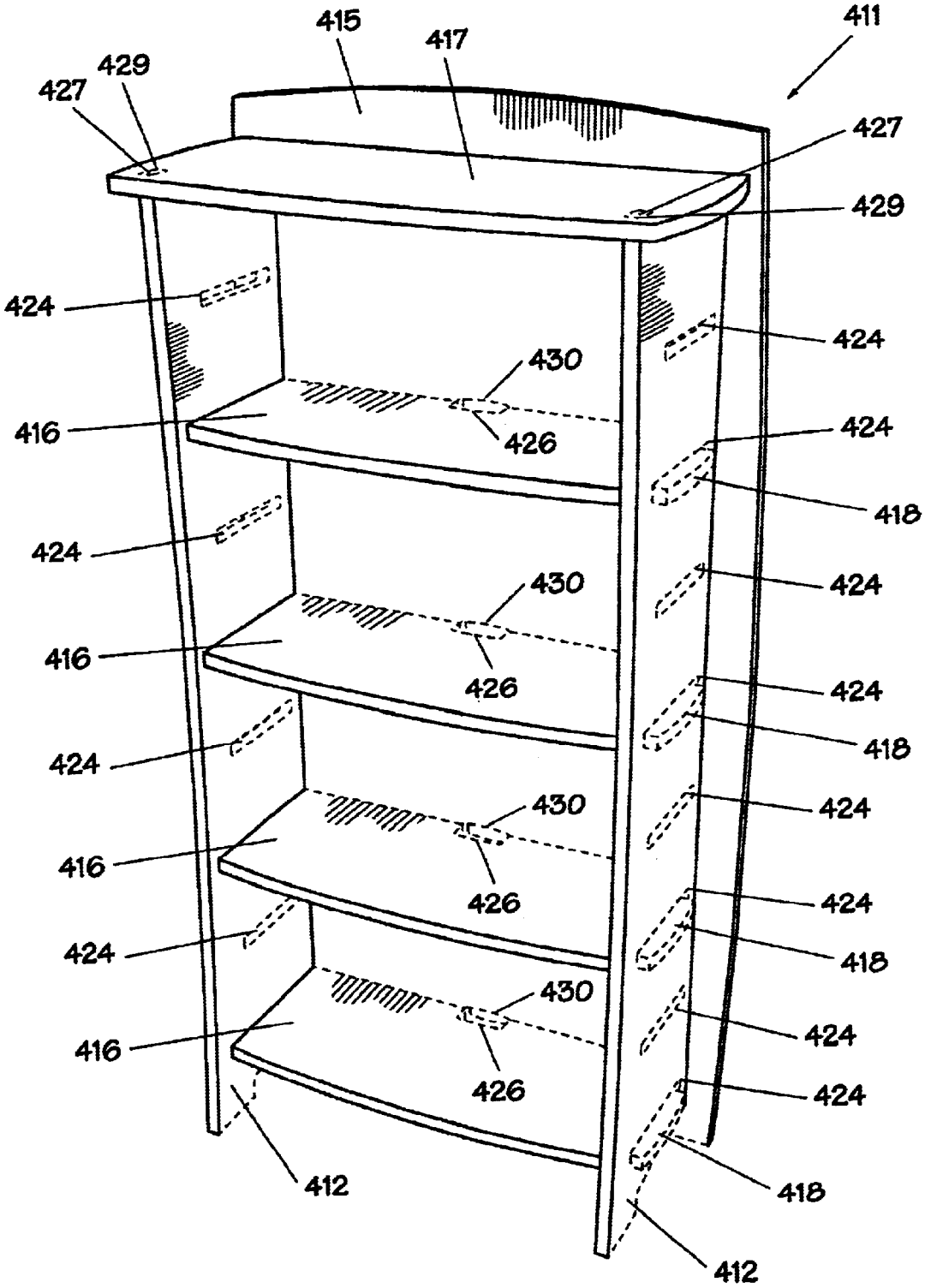
FIG. 19 is a right-side front perspective view of a bookcase according to the present invention.
Figure 20:
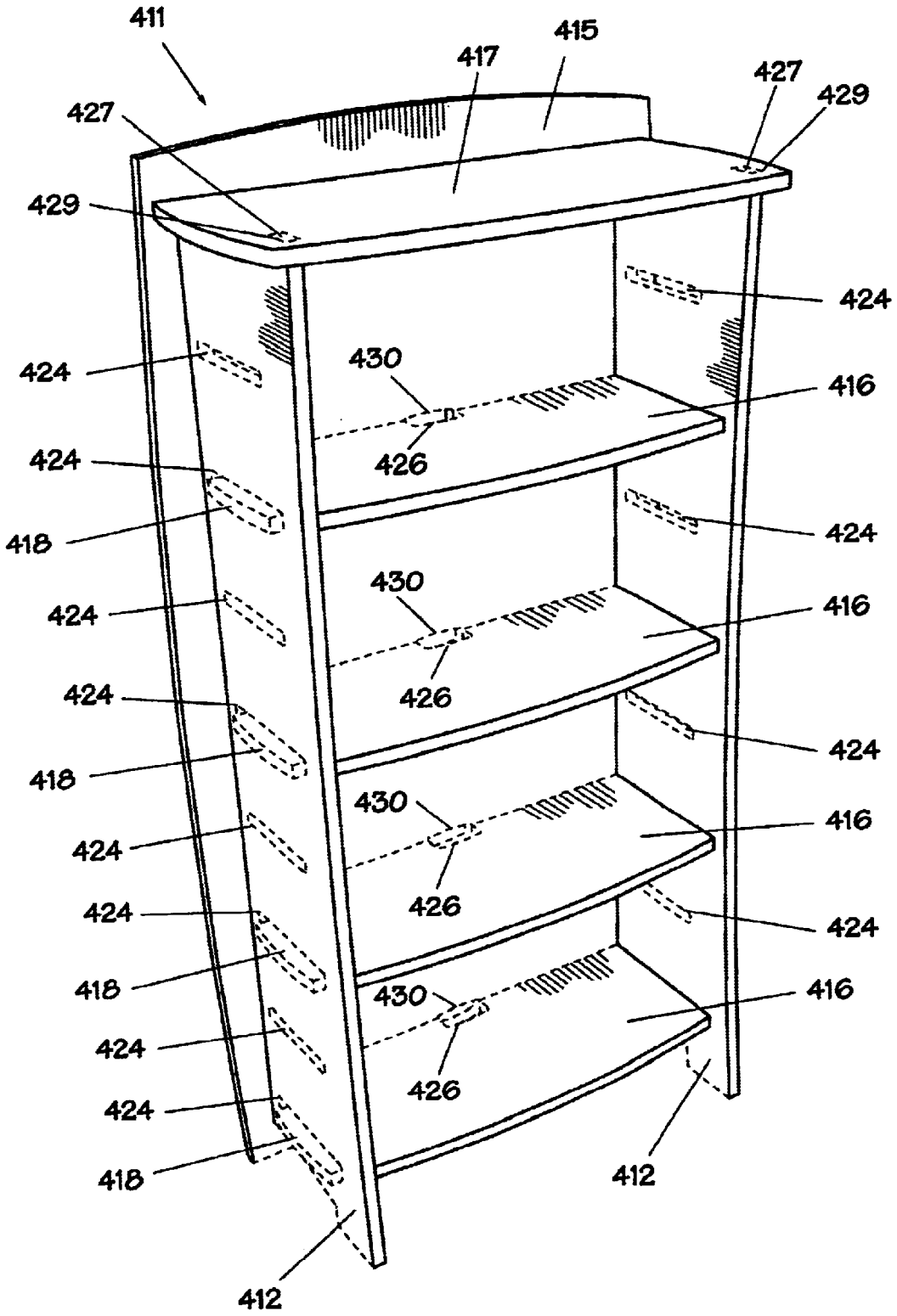
FIG. 20 is a left-side front perspective view of the bookcase of FIG. 19.
Figure 21:
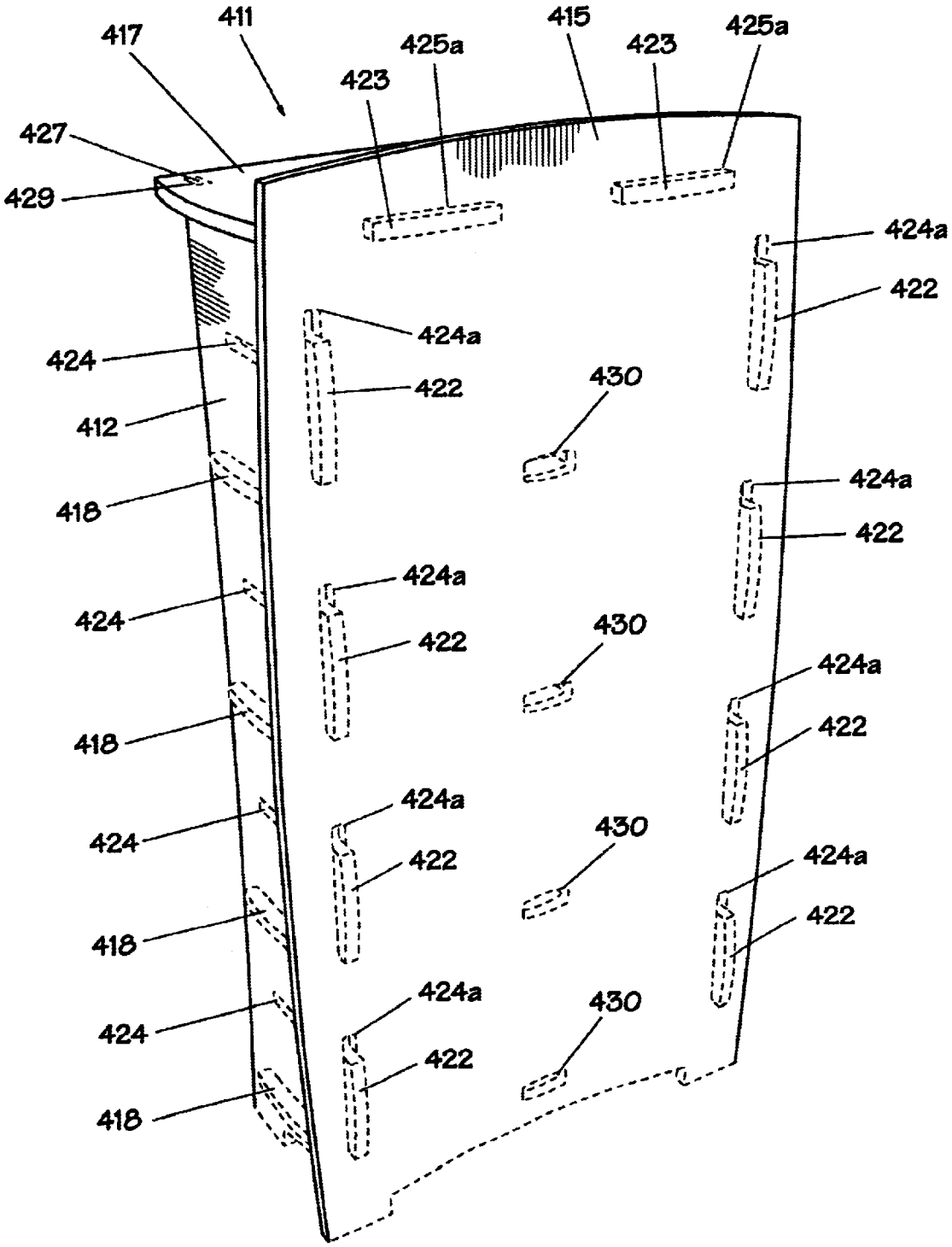
FIG. 21 is a right-side rear perspective view of the bookcase of FIG. 19.
Figure 22:
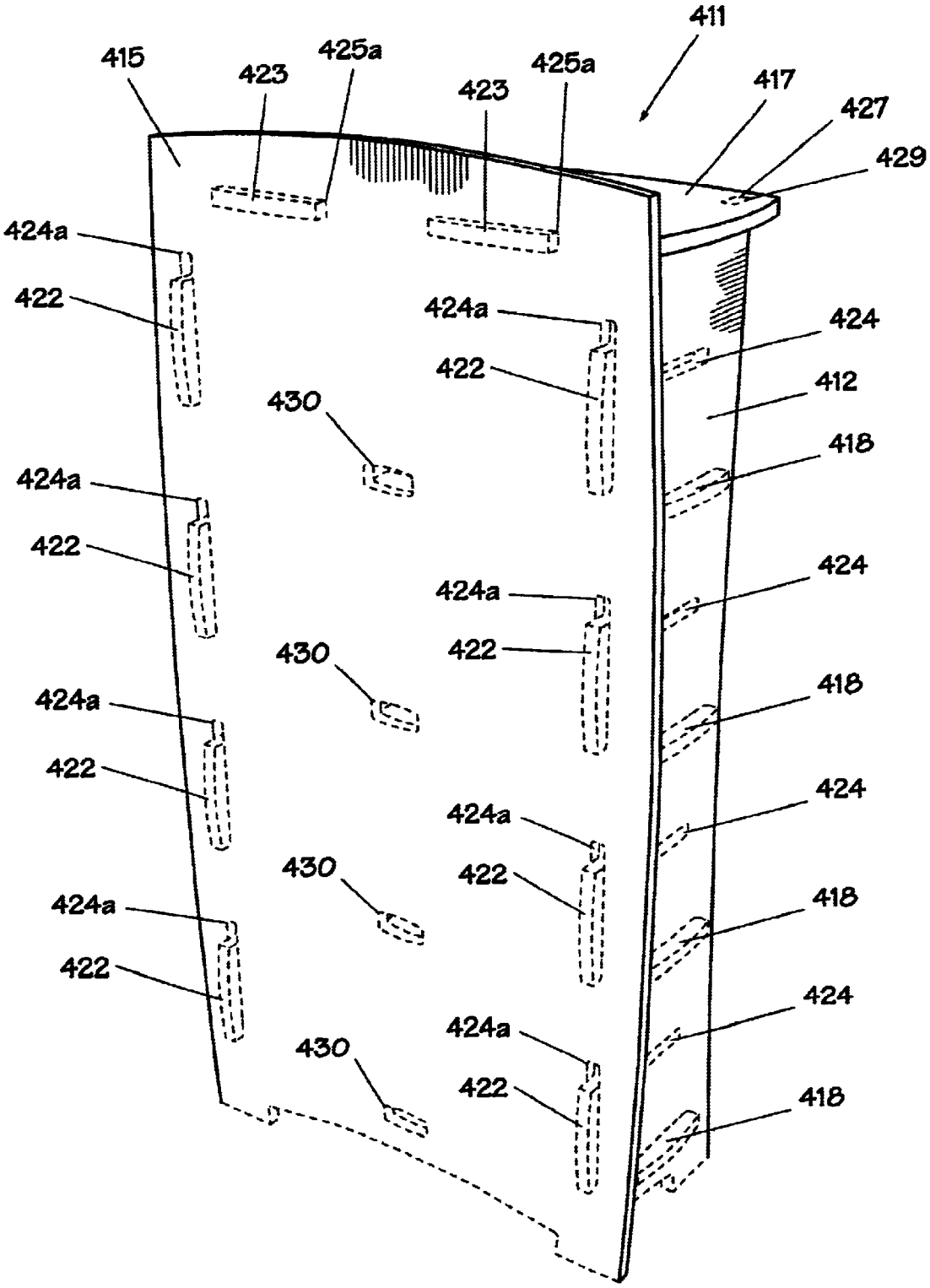
FIG. 22 is a left-side rear perspective view of the bookcase of FIG. 19.
Figure 23:
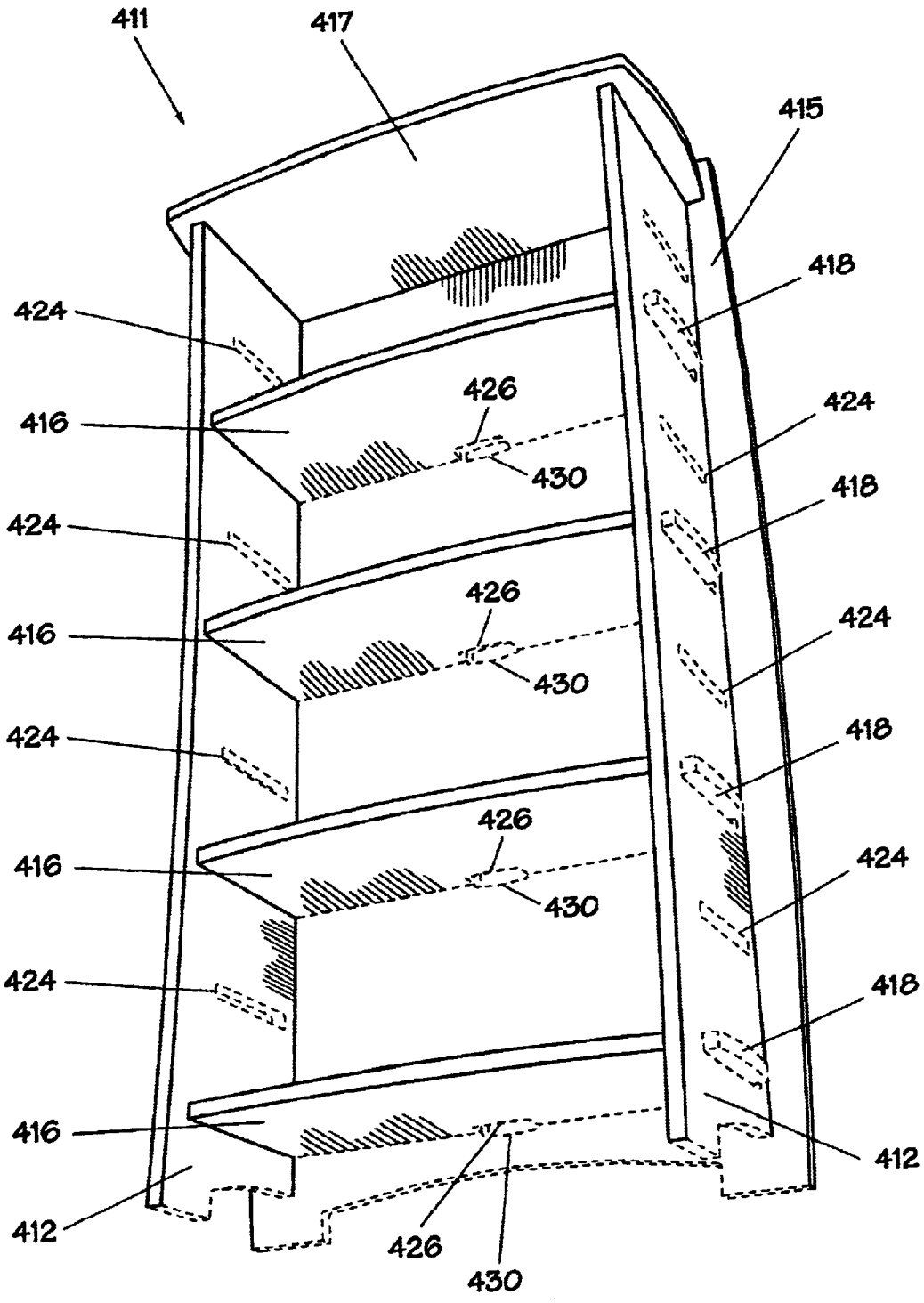
FIG. 23 is a bottom front perspective view of the bookcase of FIG. 19.

Referring to FIG. 1 in the drawings, a desk 11 made in accordance with the modular furniture system of the present invention is illustrated. Desk 11 is an example of the type of furniture that can be assembled with from the interlocking components of the present invention. As explained herein, the modular furniture system of the present invention allows a user to assemble, disassemble, and reconfigure various interchangeable and reversible components into a large variety of pieces of furniture, such as tables, generally rectangular desks, corner desks, desk returns, desk extensions, desk bridges, hutches, bookcases, end tables, and others.

Desk 11 is a corner desk interlockingly assembled from a plurality of wide vertical side supports 12, a plurality of narrow vertical side supports 13, a long vertical rear support 15, a short vertical rear support 10, and a desk work surface 17. Optionally, desk 11 may include a plurality of shelves 16 and a keyboard tray 14. Each wide vertical side support 12 includes a plurality of L-shaped connector tabs 22 which extend rearward and then downward, and a plurality of horizontal slots 24. Each narrow vertical side support 13 includes a plurality of L-shaped connector tabs 19 which extend rearward and then downward, and a plurality of horizontal slots 20. Desk work surface 17 includes a plurality of L-shaped connector tabs 23*a* which extend rearward and then to one side, and a plurality of straight connector tabs 23*b* which extend straight rearward. Each shelf 16 includes an L-shaped connector tab 18. In addition, each shelf 16 includes a notch 26 for the passing through of wires and cables.

Each connector tab 19 of each narrow vertical side support 13 is interlockingly received by a vertical slot 21*a* through long vertical rear support 15 and a vertical slot 21*b* through short vertical rear support 10. Similarly, each connector tab 22 of each wide vertical side support 12 is interlockingly received by a vertical slot 24*a* through long vertical rear support 15 and a vertical slot 24*b* through short vertical rear support 10. Short vertical rear support 10 includes a plurality of L-shaped connector tabs 32 which extend rearward and then downward. Each connector tab 32 of short vertical rear support 10 is interlockingly received by a vertical slot 34 through long vertical rear support 15. Each connector tab 23*a* of desk work surface 17 is interlockingly received by a horizontal slot 25*a* through long vertical rear support 15; and each connector tab 23*b* is slidingly received by a horizontal slot 25*b* through short vertical rear support 10. Each wide vertical side support 12 includes a vertical alignment post 27 which is received by an aperture 29 in desk extension work surface 17.

Desk work surface 17 includes at least one aperture 30 to accommodate wires for computers, phones, and other office-type equipment. Keyboard tray 14 is the only component that may require a fastener or glue. Although not shown in the figures, each narrow vertical side support 13 may include a similar vertical alignment post. Each narrow vertical side support 13 includes at least one notch 35 in the upper edge for passing through wires and cables. Each wide vertical side support 12 includes at least one notch 37 in the upper edge for receiving bowtie coupling components (see FIGS. 38A and 38B) and one notch 39 for passing through wires and cables. The assembly procedure for desk 11 will be discussed in more detail below.

Referring now to FIGS. 5–9 in the drawings, a desk extension 111 made in accordance with the modular furniture system of the present invention is illustrated. Desk extension 111 is interlockingly assembled from a plurality of wide vertical side supports 113, a vertical rear support 115, a desk extension work surface 117, and, optionally, a shelf 116. Each wide vertical side support 113 includes a plurality of L-shaped connector tabs 119 which extend rearward and then downward, and a plurality of horizontal slots 120. Desk extension work surface 117 includes a plurality of L-shaped connector tabs 123 which extend rearward and then to one side. Each shelf 116 includes an L-shaped connector tab 118. In addition, each shelf 116 includes a notch 126 for the passing through of wires and cables.

Each connector tab 119 of each vertical side support 113 is interlockingly received by a vertical slot 121 through vertical rear support 115. Similarly, each connector tab 123 of desk extension work surface 117 is received by a horizontal slot 125 through vertical rear support 115. Each wide vertical side support 113 includes a vertical post 127 which is received by an aperture 129 in desk extension work surface 117. Each wide vertical side support 113 includes at least one notch 137 in the upper edge for receiving bowtie coupling components (see FIGS. 38A and 38B) and one notch 135 for passing through equipment wires and cables.

Referring now to FIGS. 10–13 in the drawings, a desk bridge 211 made in accordance with the modular furniture system of the present invention is illustrated. Desk bridge 211 is interlockingly assembled from a plurality of wide vertical side supports 213, a vertical rear support 215, a desk bridge work surface 217, and, optionally, a shelf 216. Each wide vertical side support 213 includes a plurality of L-shaped connector tabs 219 which extend rearward and then downward, and a plurality of horizontal slots 220. Desk bridge work surface 217 includes a plurality of connector tabs 223 which extend rearward. Each shelf 216 includes an L-shaped connector tab 218. In addition, each shelf 116 includes a notch 226 for the passing through of wires and cables.

Each connector tab 219 of each wide vertical side support 213 is interlockingly received by a vertical slot 221 through vertical rear support 215. Similarly, each connector tab 223 of desk bridge work surface 217 is received by a horizontal slot 225 through vertical rear support 215. Each wide vertical side support 213 includes a vertical post 227 which is received by an aperture 229 in desk bridge work surface 217. Each wide vertical side support 213 includes at least one notch 237 in the upper edge for receiving bowtie coupling components (see FIGS. 38A and 38B), and one notch 235 for passing through equipment wires and cables.

Referring now to FIGS. 14–18 in the drawings, a generally rectangular desk 311 according to the present invention is illustrated. Desk 311 is interlockingly assembled from a plurality of wide vertical side supports 312, a plurality of narrow vertical side supports 313, a vertical rear support 315, and a desk work surface 317. Optionally, desk 311 may include a plurality of shelves 316. Each wide vertical side support 312 includes a plurality of L-shaped connector tabs 322 which extend rearward and then downward, and a plurality of horizontal slots 324. Each narrow vertical side support 313 includes a plurality of L-shaped connector tabs 319 which extend rearward and then downward, and a plurality of horizontal slots 320. Desk work surface 317 includes a plurality of L-shaped connector tabs 323 which extend rearward and then to one side. Each shelf 316 includes an L-shaped connector tab 318. In addition, each shelf 316 includes a notch 326 for the passing through of wires and cables.

Each connector tab 319 of each narrow vertical side support 313 is interlockingly received by a vertical slot 321*a* through vertical rear support 315. Similarly, each connector tab 322 of each wide vertical side support 312 is interlockingly received by a vertical slot 324*a* through vertical rear support 315. Each connector tab 323 of desk work surface 317 is received by a horizontal slot 325*a* through vertical rear support 315. Each wide vertical side support 312 includes a vertical alignment post 327 which is received by an aperture 329 in desk work surface 317.

Desk work surface 317 includes at least one aperture 330 to accommodate wires and cables for computers, phones, and other office-type equipment. Although not shown in the figures, each narrow vertical side support 313 may include a vertical alignment post. Each wide vertical side support 313 includes at least one notch 335 in the upper edge for passing through wires and cables. Each wide vertical side support 312 includes at least one notch 337 in the upper edge for receiving bowtie coupling components (see FIGS. 38A and 38B) and one notch 335 for passing though wires and cables. The assembly procedure for desk 311 is similar to the procedure for desk 11.

Referring now to FIGS. 19–23 in the drawings, a bookcase 411 according to the present invention is illustrated. Bookcase 411 is interlockingly assembled from a plurality of vertical side supports 412, a vertical rear support 415, and a top surface 417. Preferably, bookcase 411 includes a plurality of shelves 416. Each vertical side support 412 includes a plurality of L-shaped connector tabs 422 which extend rearward and then downward, and a plurality of horizontal slots 424. Top surface 417 includes a plurality of connector tabs 423 which extend rearward. Each shelf 416 includes an L-shaped connector tab 418. In addition, each shelf 416 includes a notch 426 for the passing through of wires and cables.

Each connector tab 422 of each vertical side support 412 is interlockingly received by a vertical slot 424*a* through vertical rear support 415. Each connector tab 423 of top surface 417 is received by a horizontal slot 425*a* through vertical rear support 415. Each vertical side support 412 includes a vertical alignment post 427 which is received by an aperture 429 in top surface 417.

Vertical rear support 415 includes at least one aperture 430 to accommodate wires and cables for computers, phones, and other office-type equipment. Although not shown in the figures, each vertical side support 412 may include at least one notch in the upper edge for receiving bowtie coupling components (see FIGS. 38A and 38B) and passing through wires and cables. The assembly procedure for bookcase 411 is similar to the procedure for desk extension 111.

Figure 24:
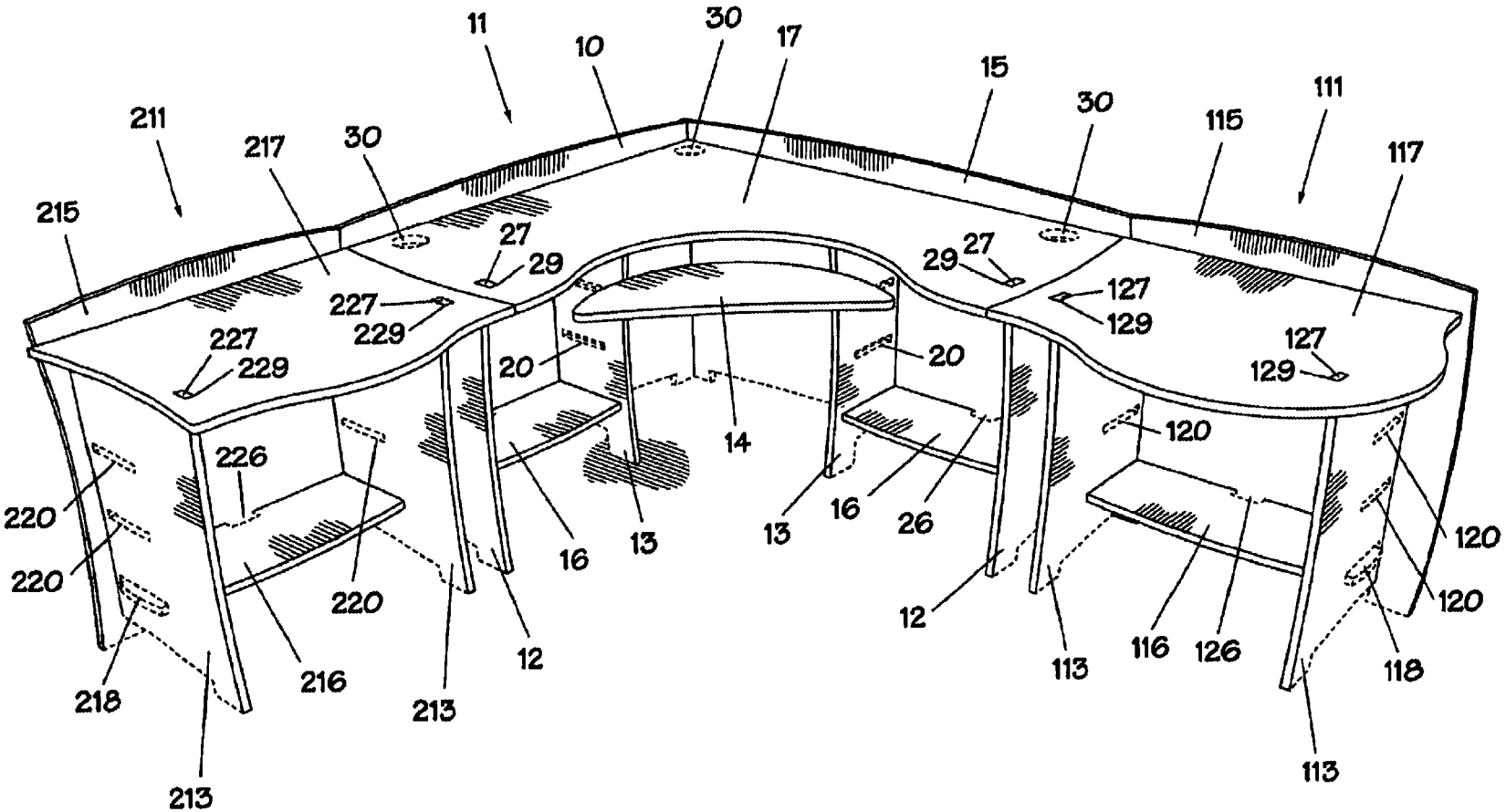
FIG. 24 is a front perspective view of an assembled desk, desk bridge, and desk extension assembled in a right-hand configuration according to the present invention.
Figure 25:
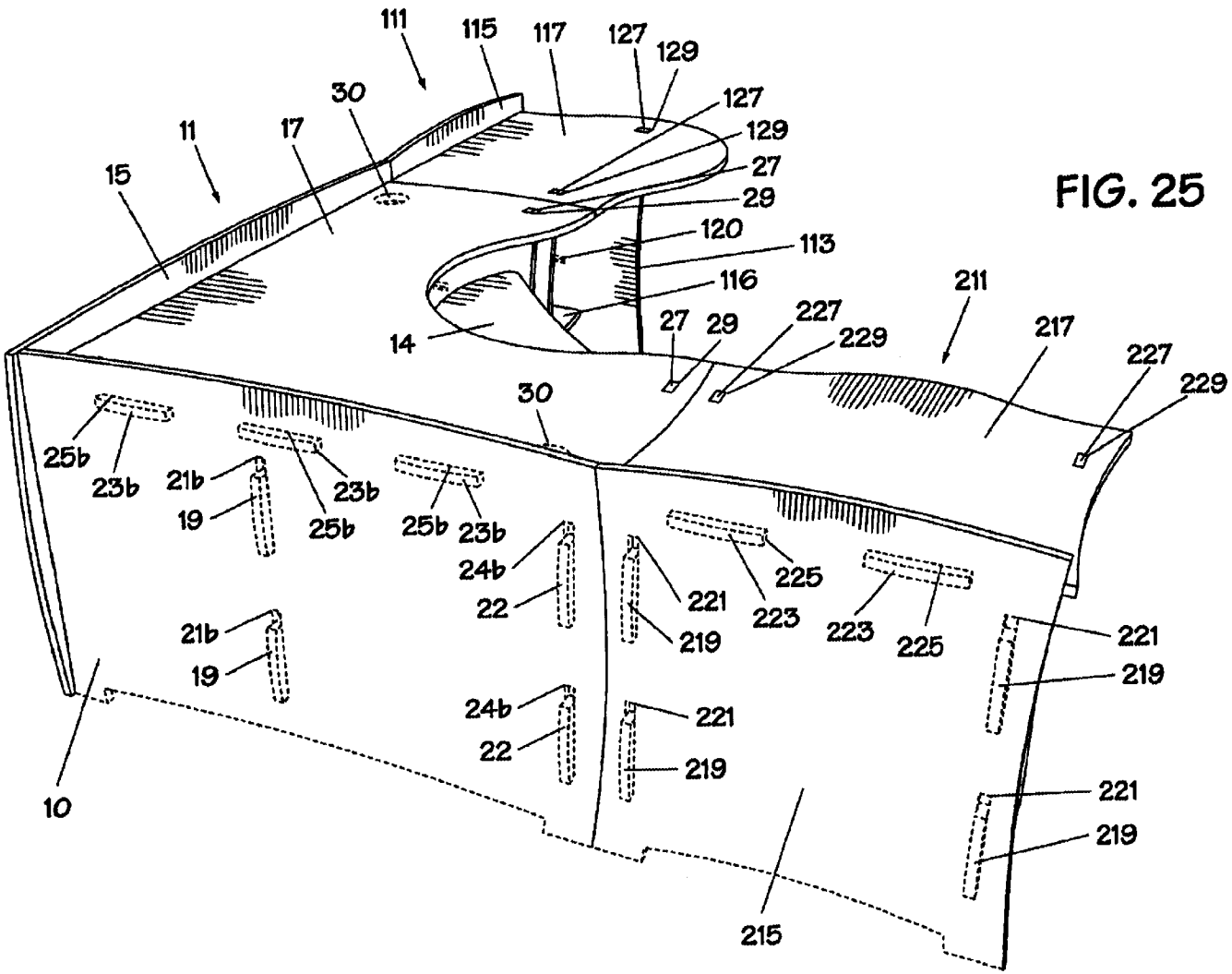
FIG. 25 is left-side rear perspective view of the assembled desk, desk bridge, and desk extension of FIG. 24.
Figure 26:
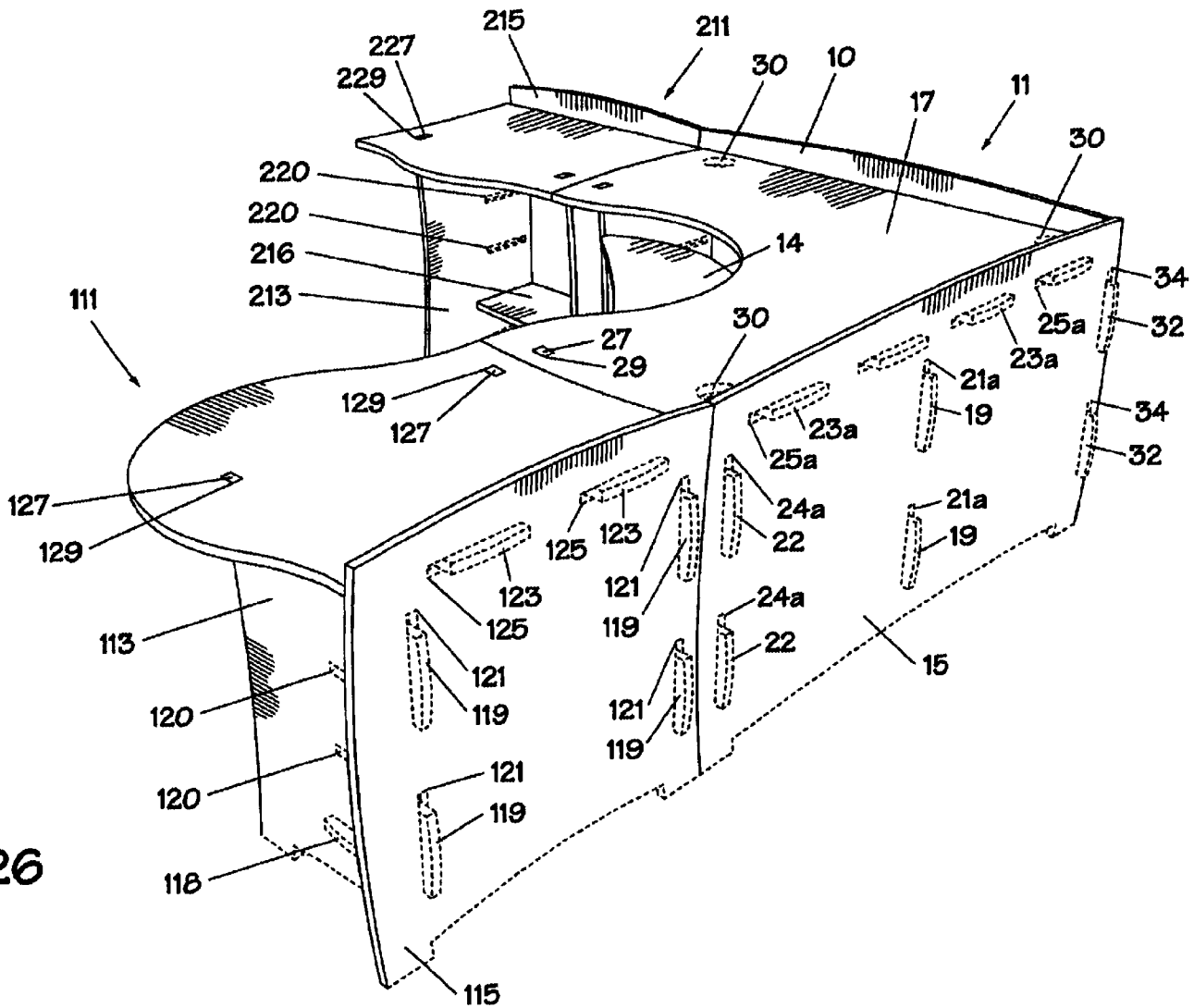
FIG. 26 is a right-side rear perspective view of the assembled desk, desk bridge, and desk extension of FIG. 24.
Figure 27:
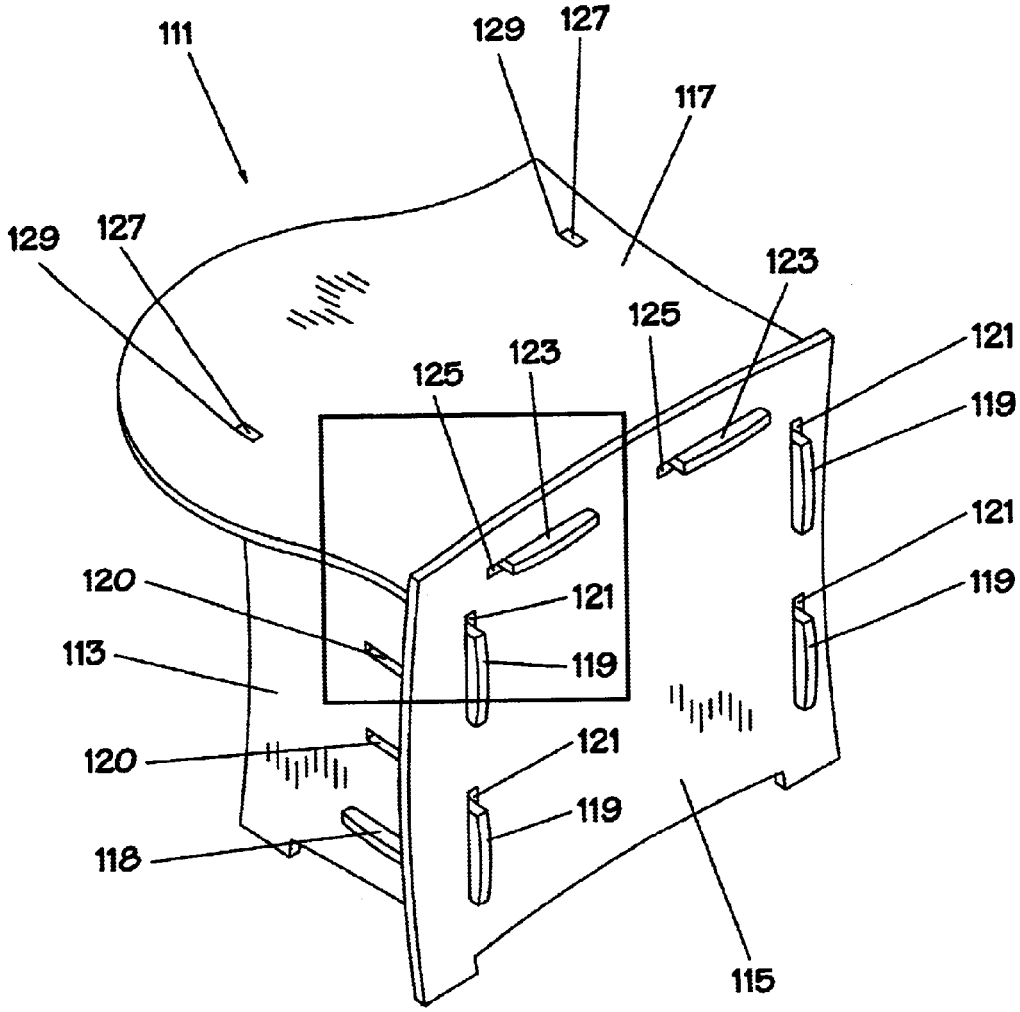
FIGS. 27–36 are perspective views and detailed perspective views illustrating the interlocking assembly of the desk extension of FIGS. 5–9.

Referring now to, FIGS. 24–26 in the drawings, desk 11, desk extension 111, and desk bridge 211 have been assembled together according to the method of the present invention. Thus assembled, desk work surface 17, desk extension work surface 117, and desk bridge work surface 217 form a level, continuous work surface. The configuration illustrated in FIGS. 24–26 is considered a "right-hand configuration," as desk extension 111 is interlockingly coupled to the right-hand side of desk 111. It should be understood that the same components could be disassembled, reversed, and reassembled to form a "left-hand configuration" in which desk extension 11 extends to the left-hand side of desk 11. The interlocking coupling of desks 11, desk extensions 111, and desk bridges 211 will be discussed in more detail below with respect to FIGS. 37A, 37B, 38A, 38B, and 39.

Figure 28:
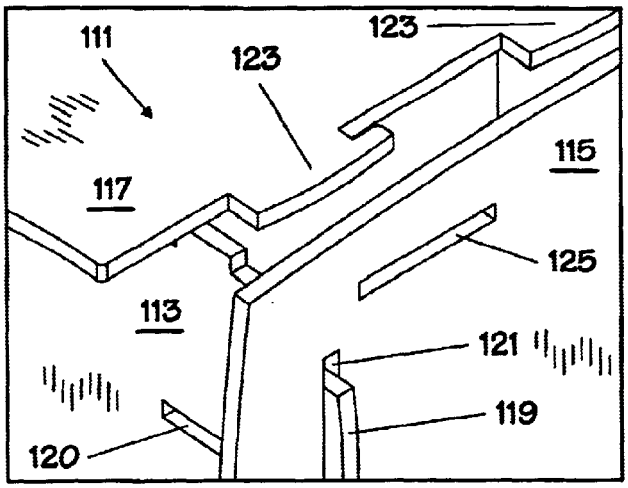
Figure 29:
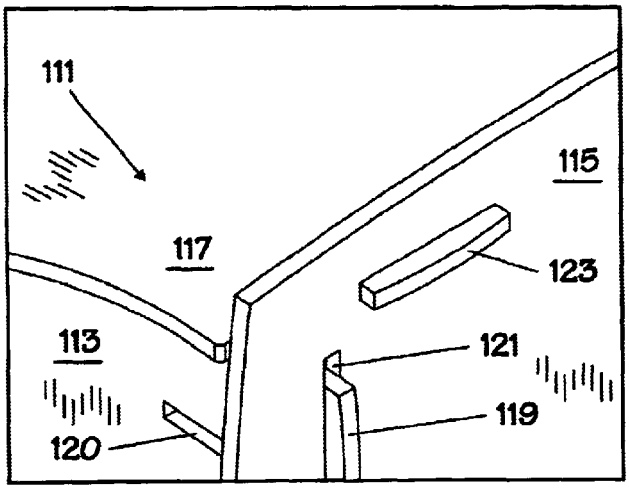
Figure 30:
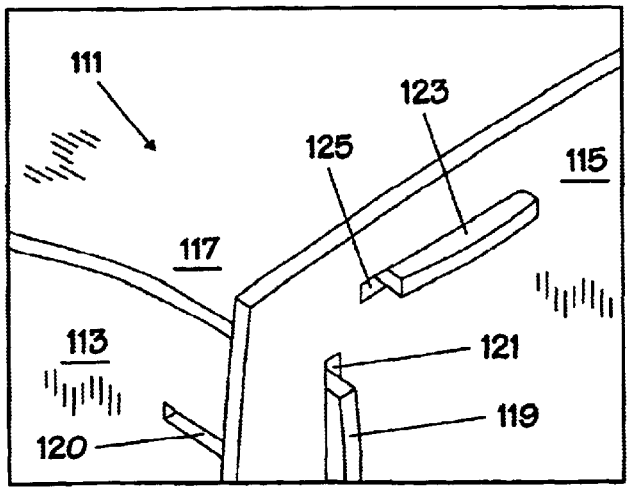
Figure 31:
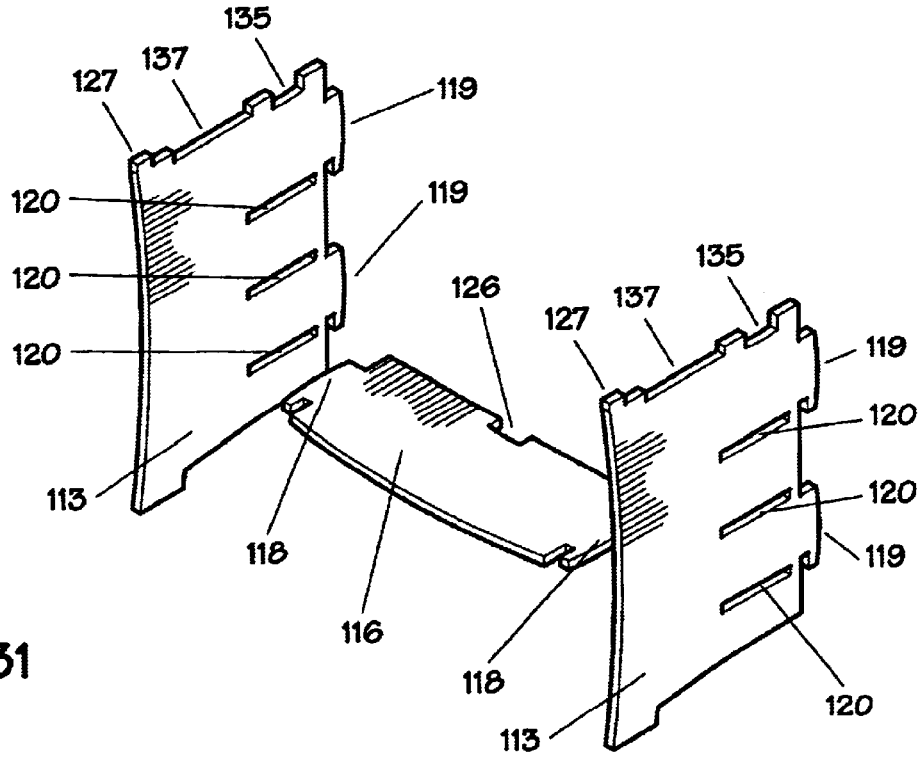
Figure 32:
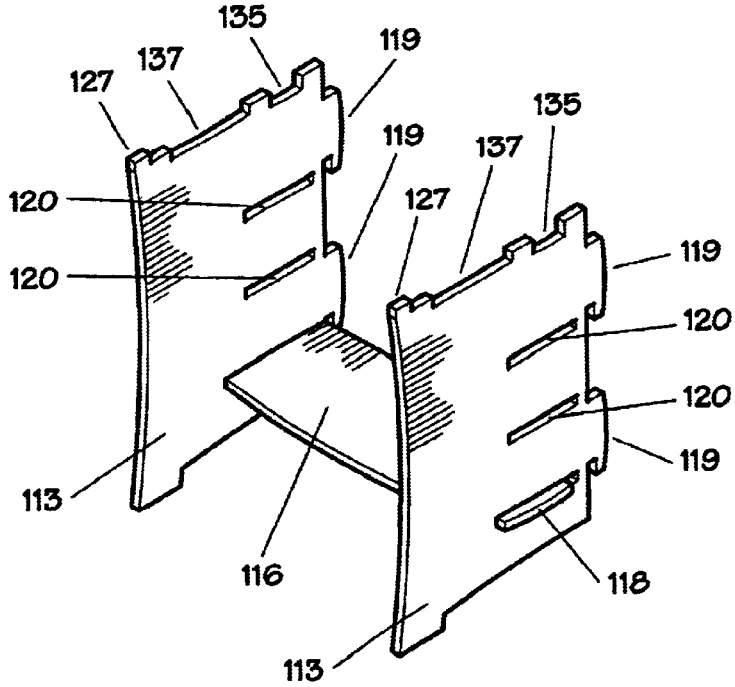
Figure 33:
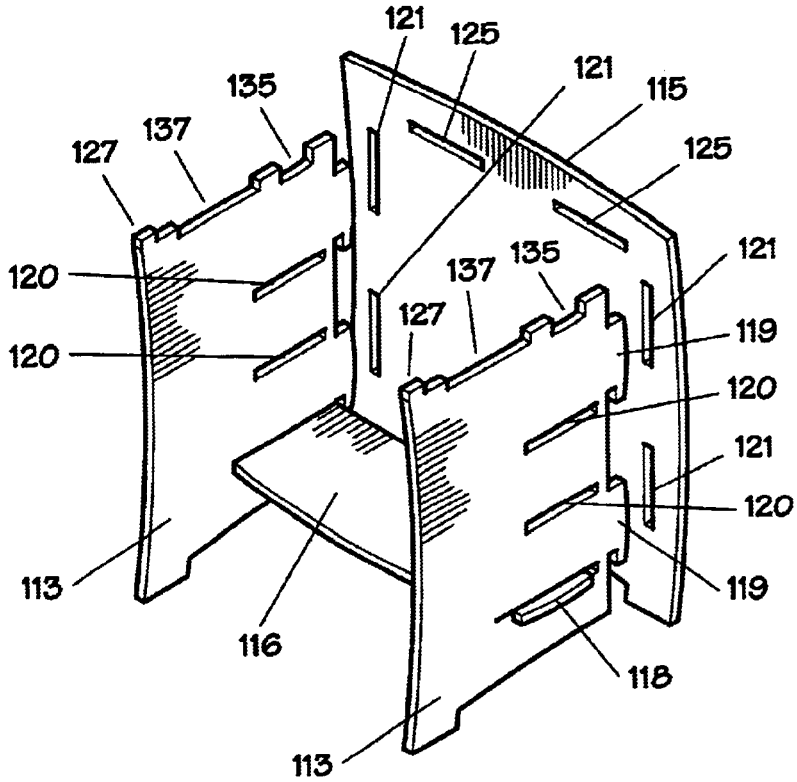
Figure 34:
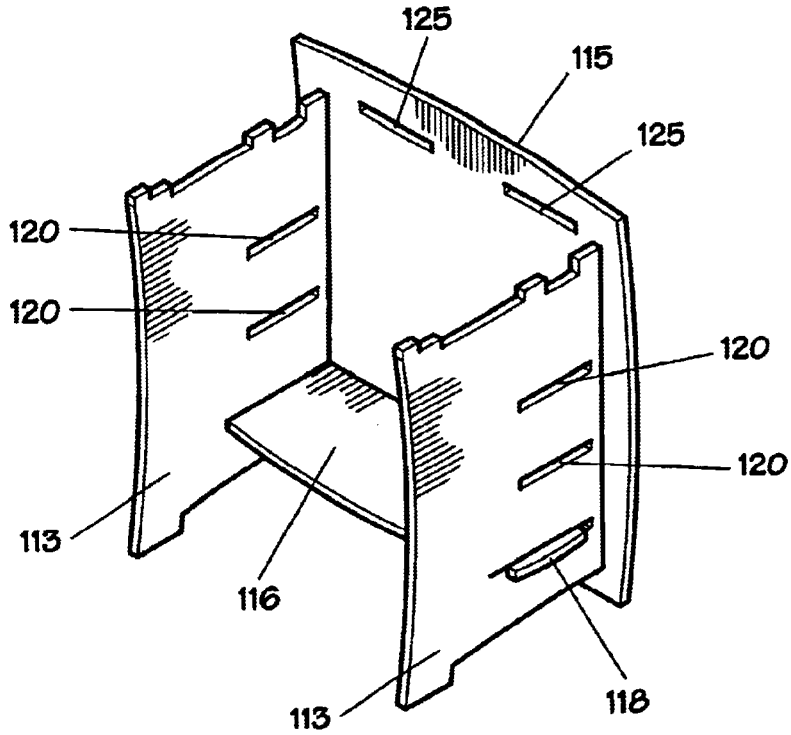
Figure 35:
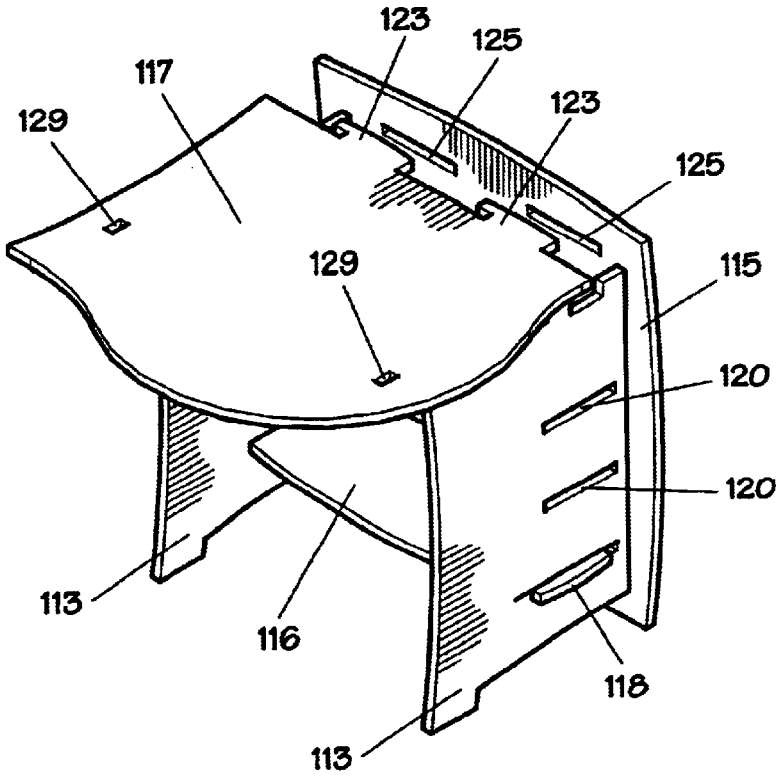

Referring now to FIGS. 27–36 in the drawings, the assembly procedure of desk extension 111 is illustrated. FIGS. 28–30 are enlarged views of the square portion indicated in FIG. 27. First, if optional shelves 116 are desired, shelves 116 are interlockingly coupled between wide vertical side supports 113 by passing connector tabs 118 through horizontal slots 120 and sliding shelf 116 forward. Then, wide vertical side supports 113 are interlockingly coupled to vertical rear support 115 by passing connector tabs 119 through vertical slots 121 and sliding downward. Then, desk extension work surface 117 is interlockingly coupled to vertical rear support 115 by passing connector tabs 123 through horizontal slots 125 and sliding sideways. Desk extension 111 is held together by aligning apertures 129 with vertical posts 127 and lowering desk extension work surface 117 onto vertical side supports 113. It should be understood that a slight clearance between connector tabs and slots is preferable to allow the components to be manually "wiggled" during assembly. However, the interlocking nature of the assembly ensures that the assembled product is sturdy and rigid.

Figure 36:
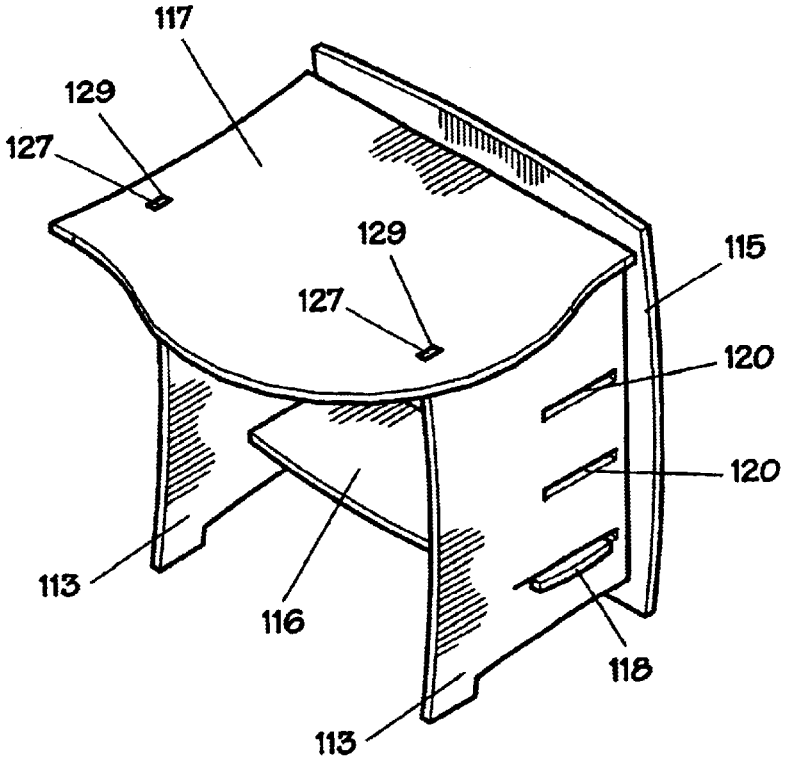
Figure 36C:
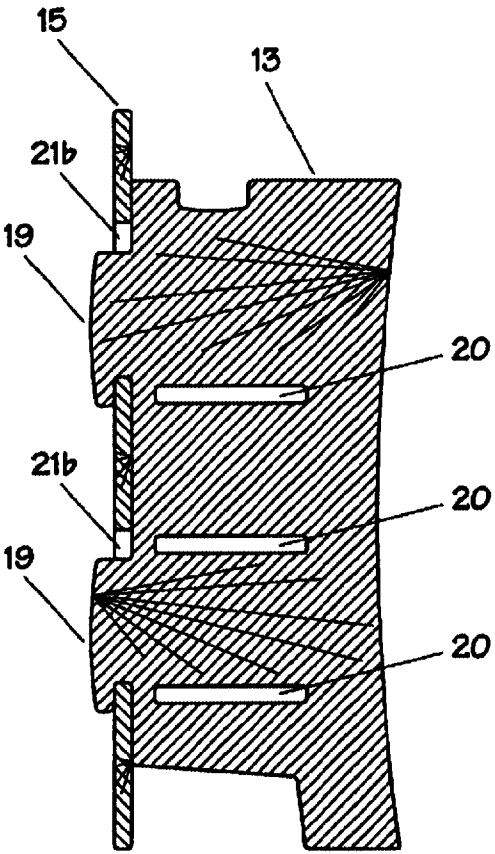
FIGS. 36A–36C are cross-sectional views of the assembly of a narrow vertical side support and a vertical rear support according to the present invention.
Figure 36B:
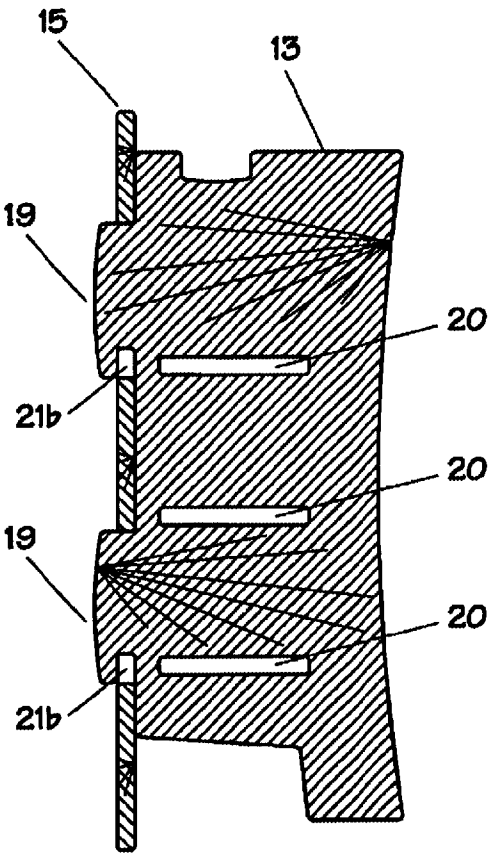
Figure 36A:
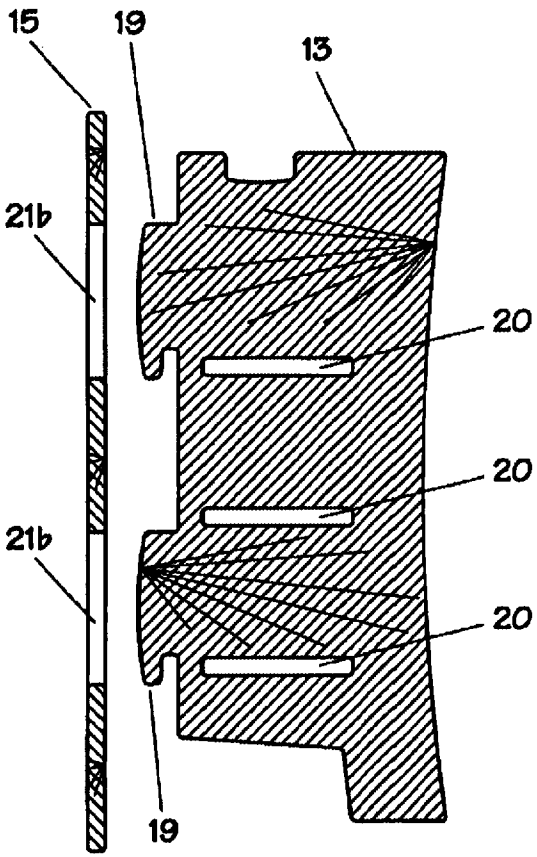

Referring now to FIGS. 36A–36C in the drawings, cross-sectional views of the assembly of narrow vertical side support 13 and long vertical rear support 15 are illustrated. As is shown, L-shaped tabs 19 are configured such that tabs 19 snuggly fit into slots 21*b* when inserted through slots 21*b* in one direction and then translated in a substantially perpendicular direction. This arrangement is similar for all L-shaped connectors and slots. This prevents the components from moving in the direction of original insertion.

Figure 37A:
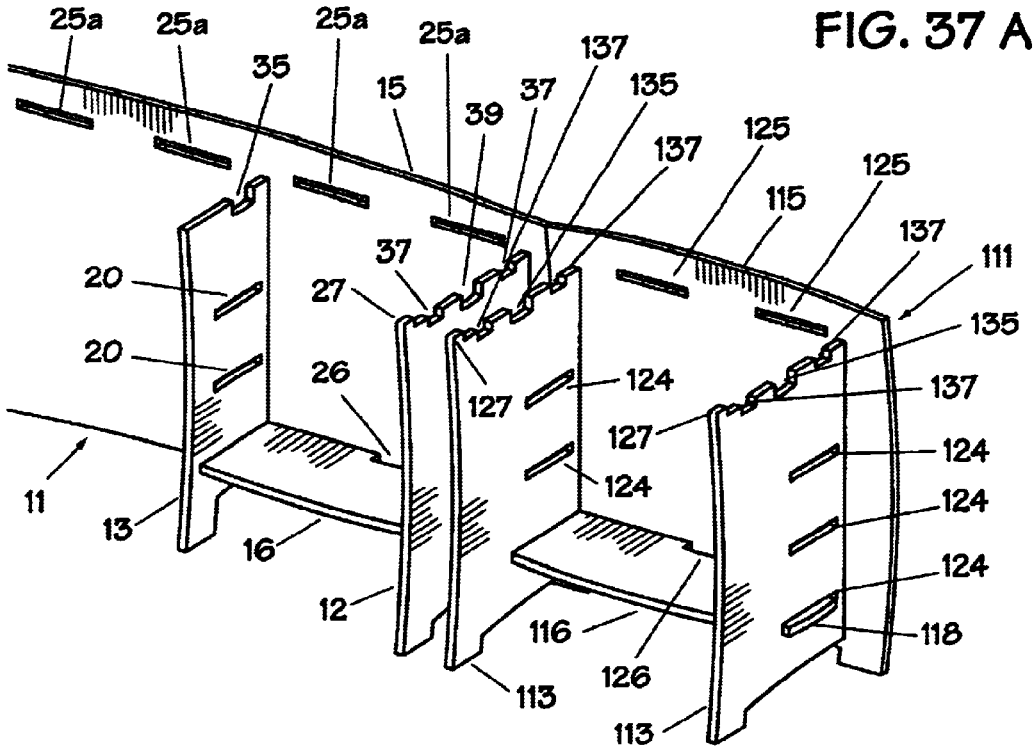
FIGS. 37A, 37B, 38A, 38B, and 39 are perspective views illustrating two embodiments of the interlocking assembly procedure of the desk of FIGS. 1–4 and the desk extension of FIGS. 5–9, one using a single bowtie component and the another using a double bowtie component according to the modular furniture system of the present invention.
Figure 38A:
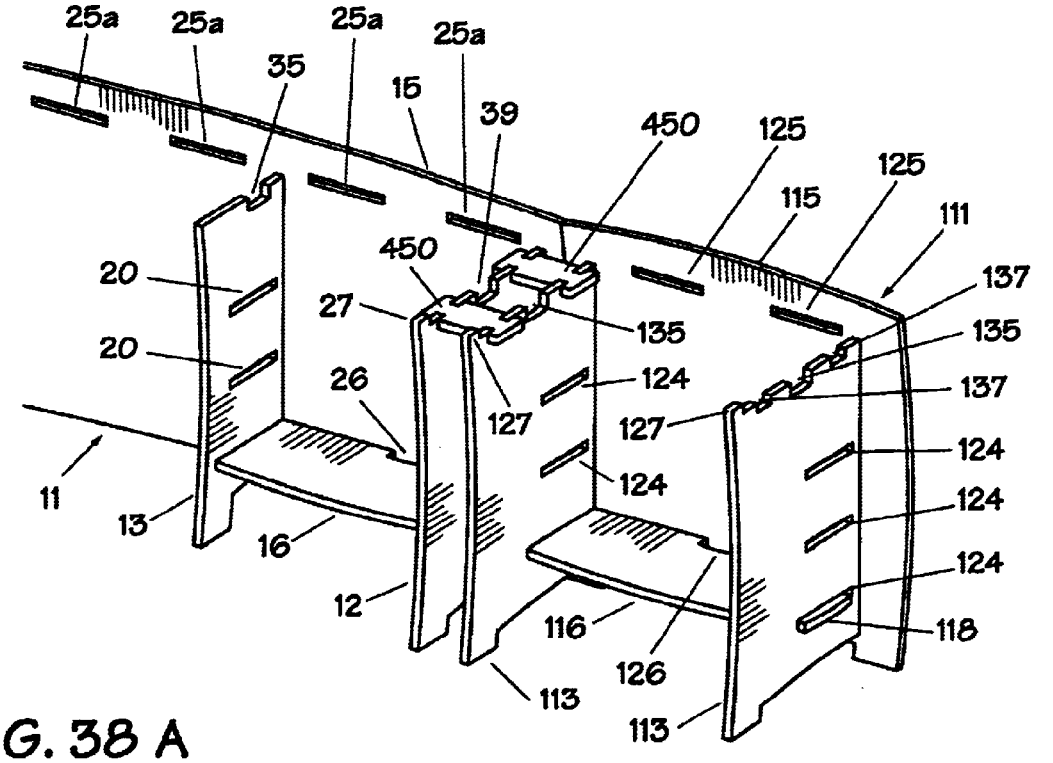
Figure 37B:
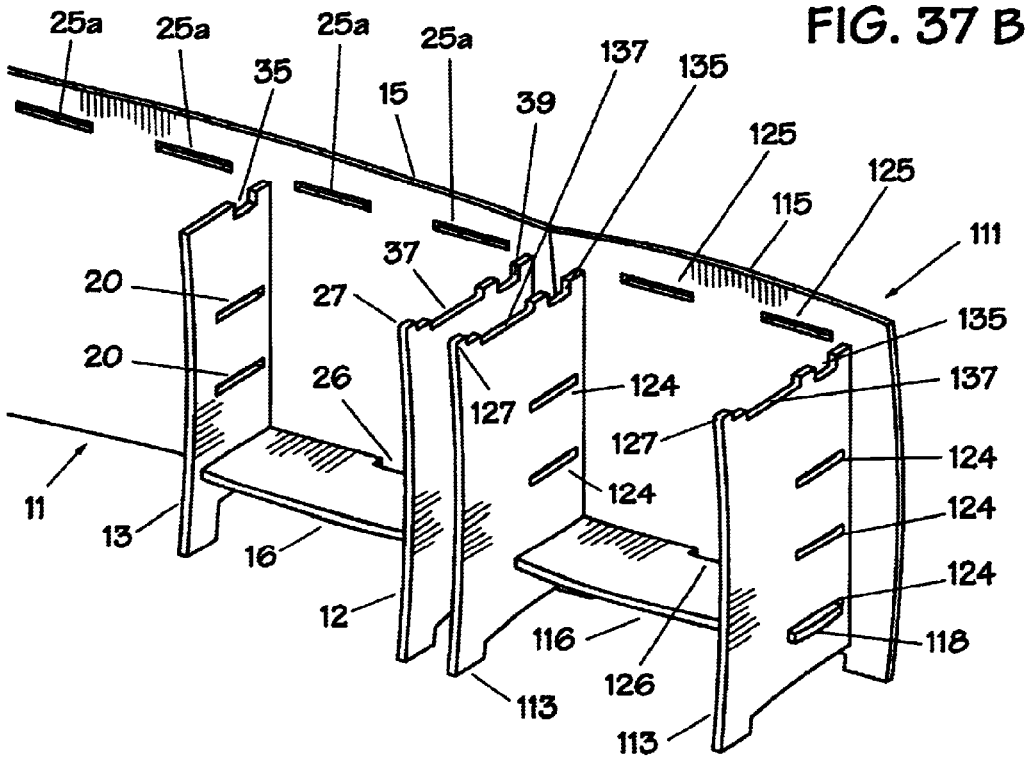
Figure 38B:
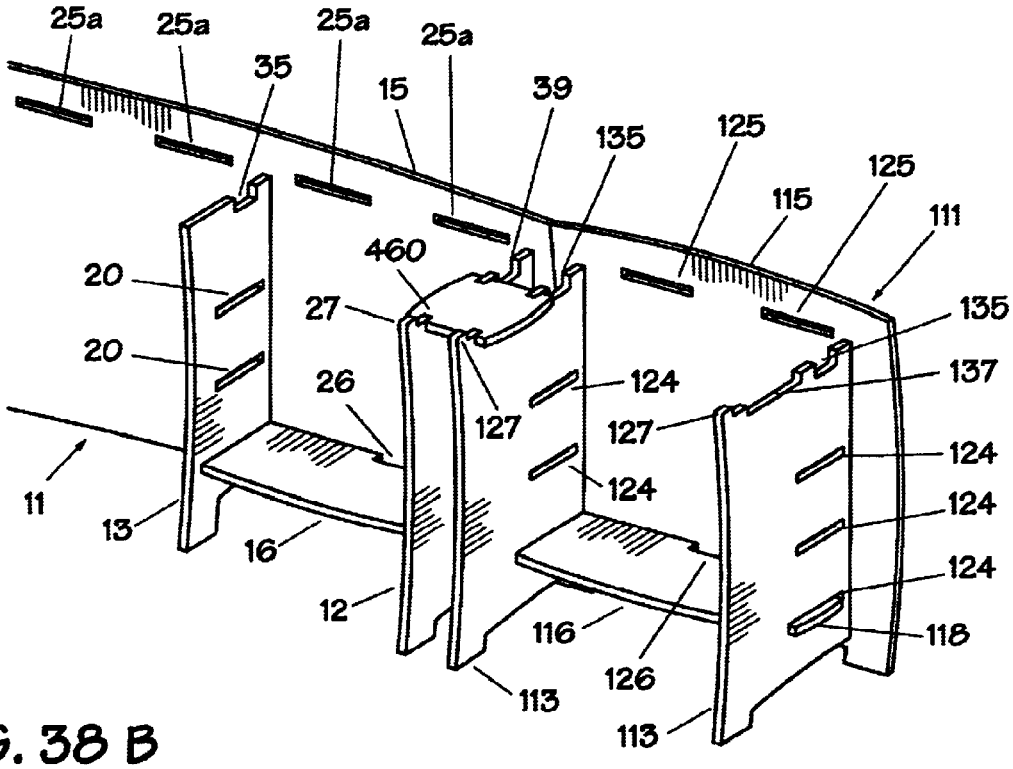
Figure 39:
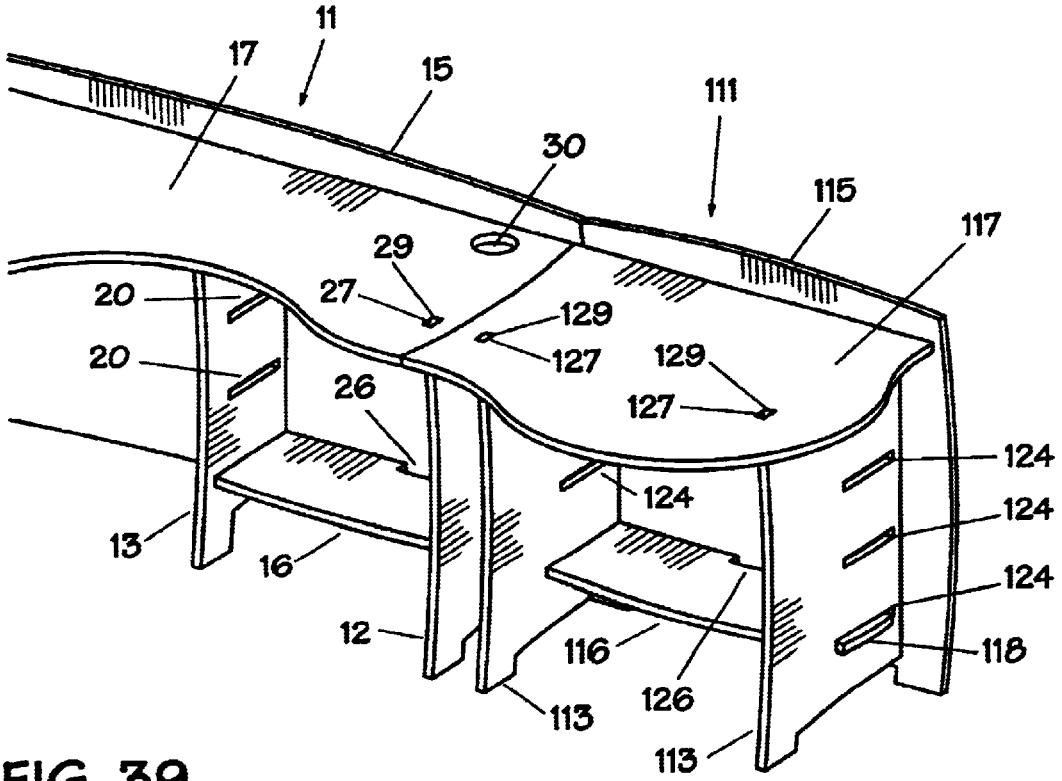
Figure 40:
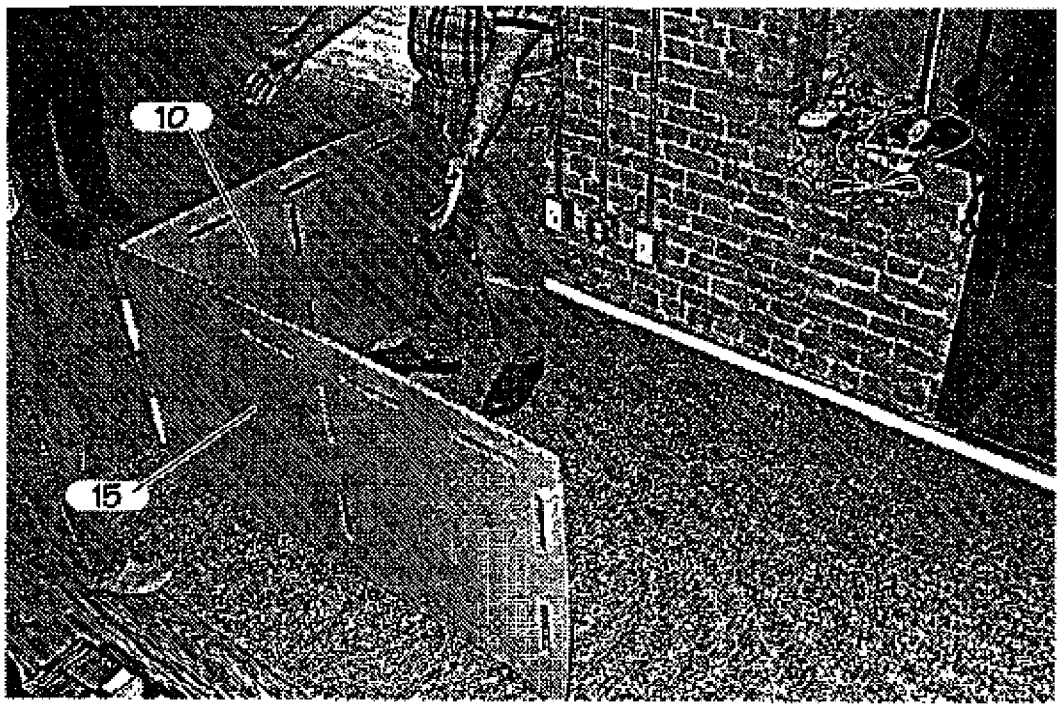
FIGS. 40–46 illustrate the interlocking assembly procedure for assembling a desk and desk extension in a left-hand configuration according to the present invention.
Figure 41:
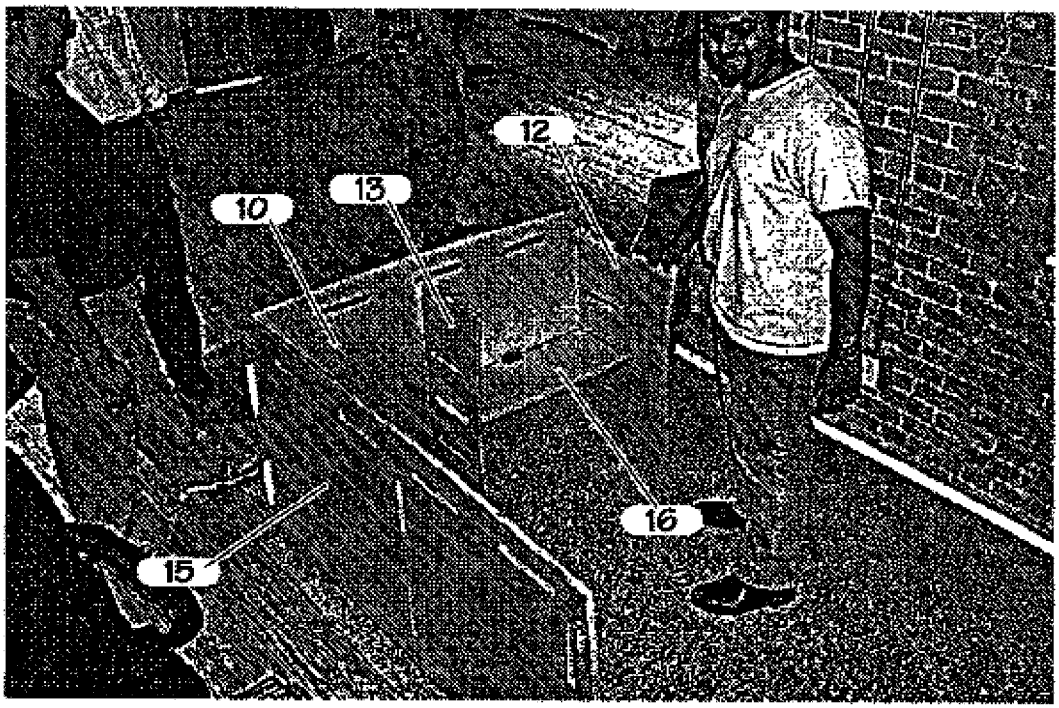
Figure 42:
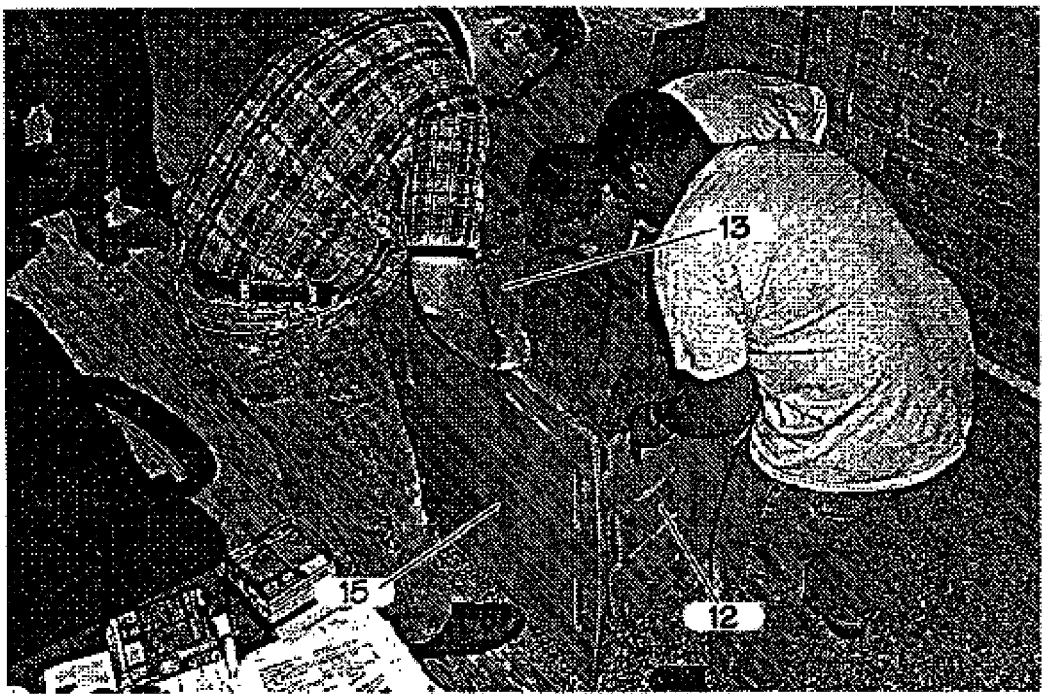
Figure 43:
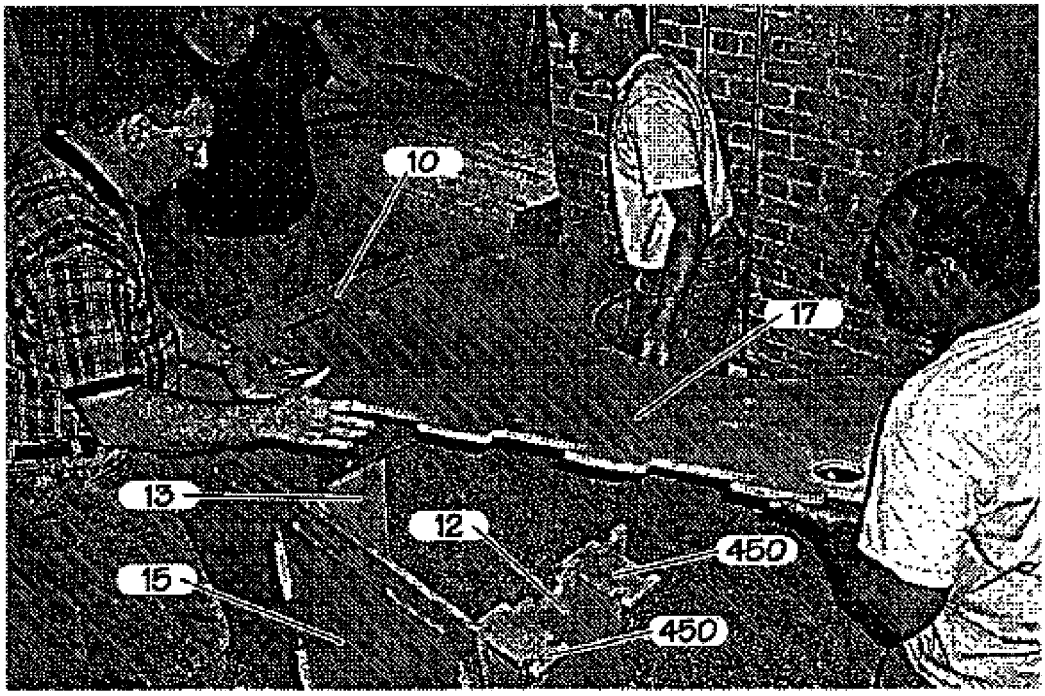
Figure 44:
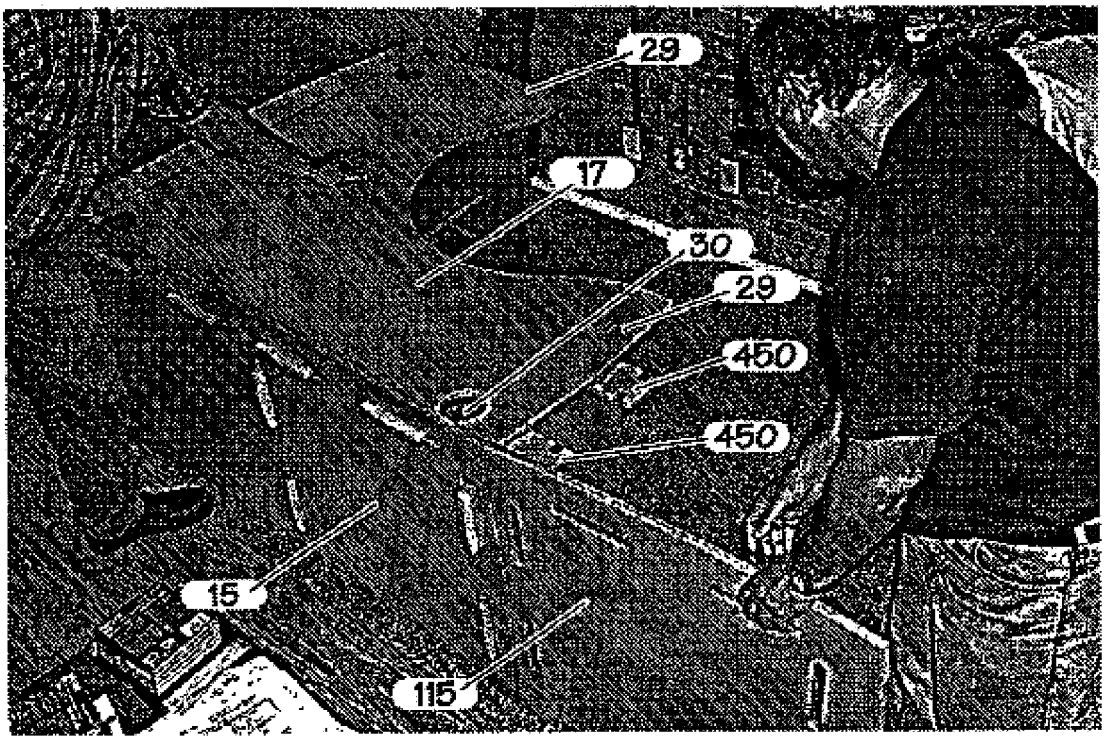
Figure 45:
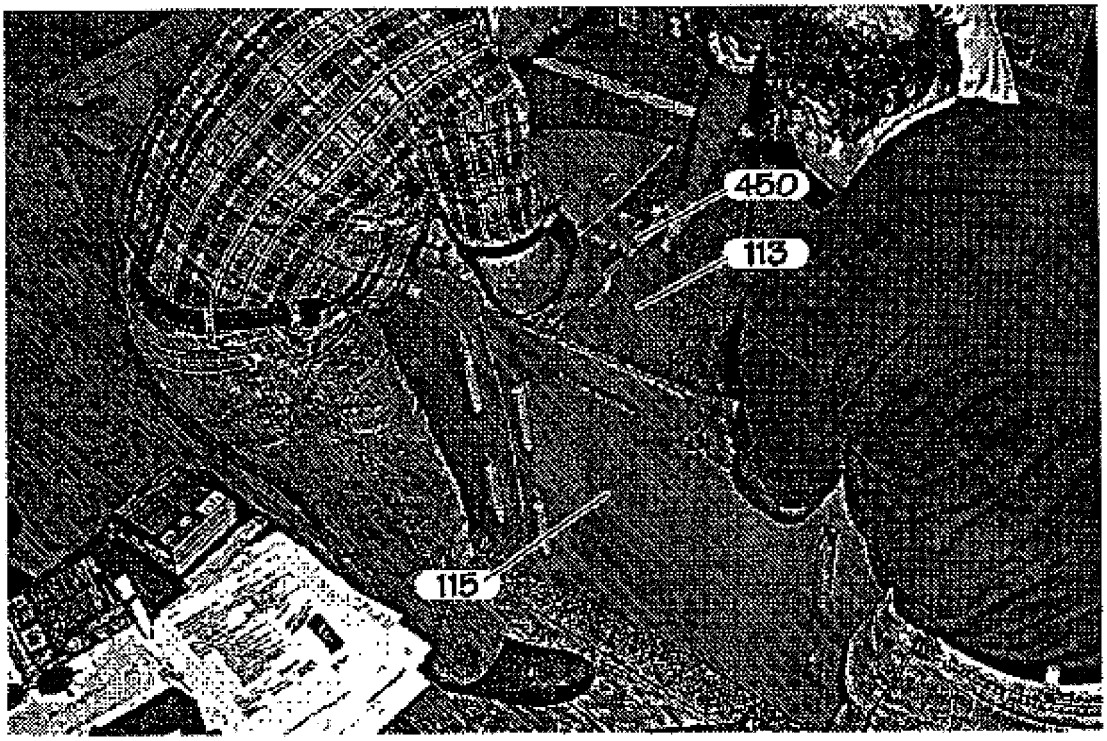
Figure 46:
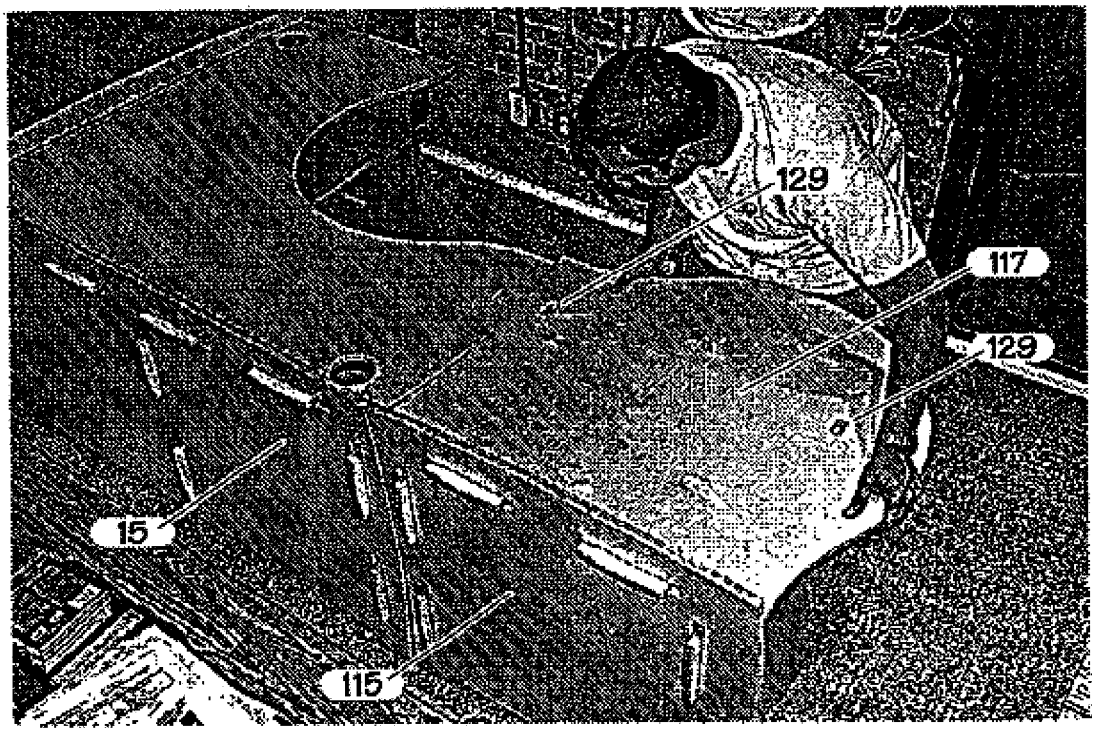
Figure 47:
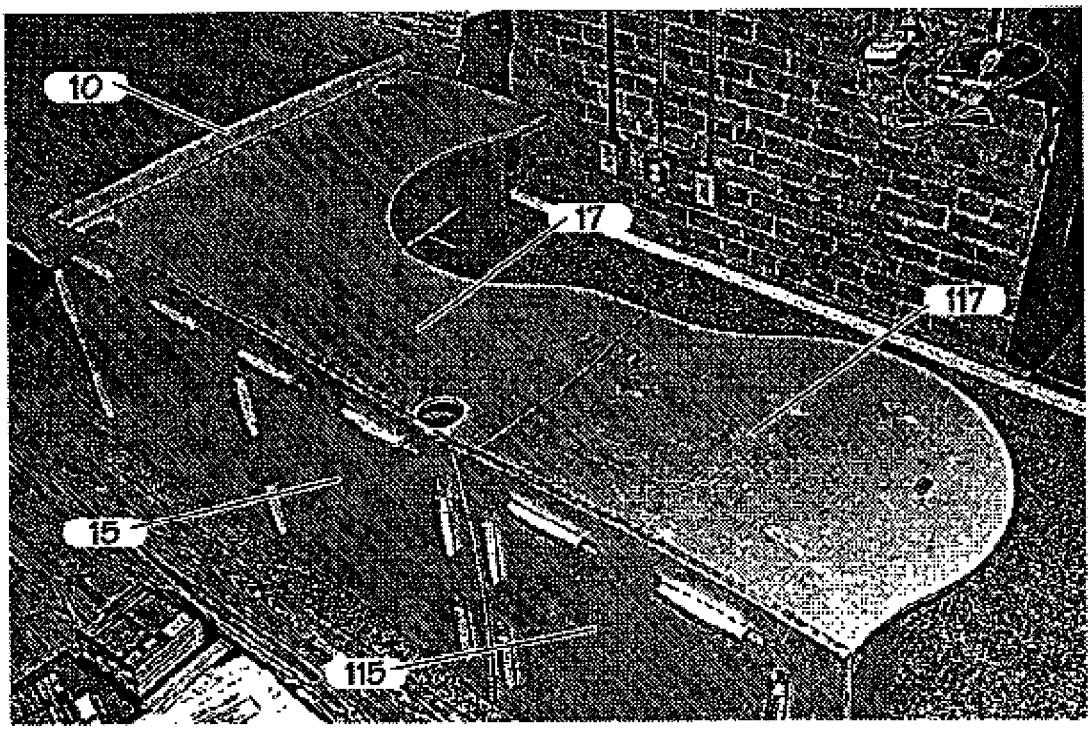
FIGS. 47–50 illustrate the assembled left-hand configured desk and desk extension of FIGS. 40–46.
Figure 48:
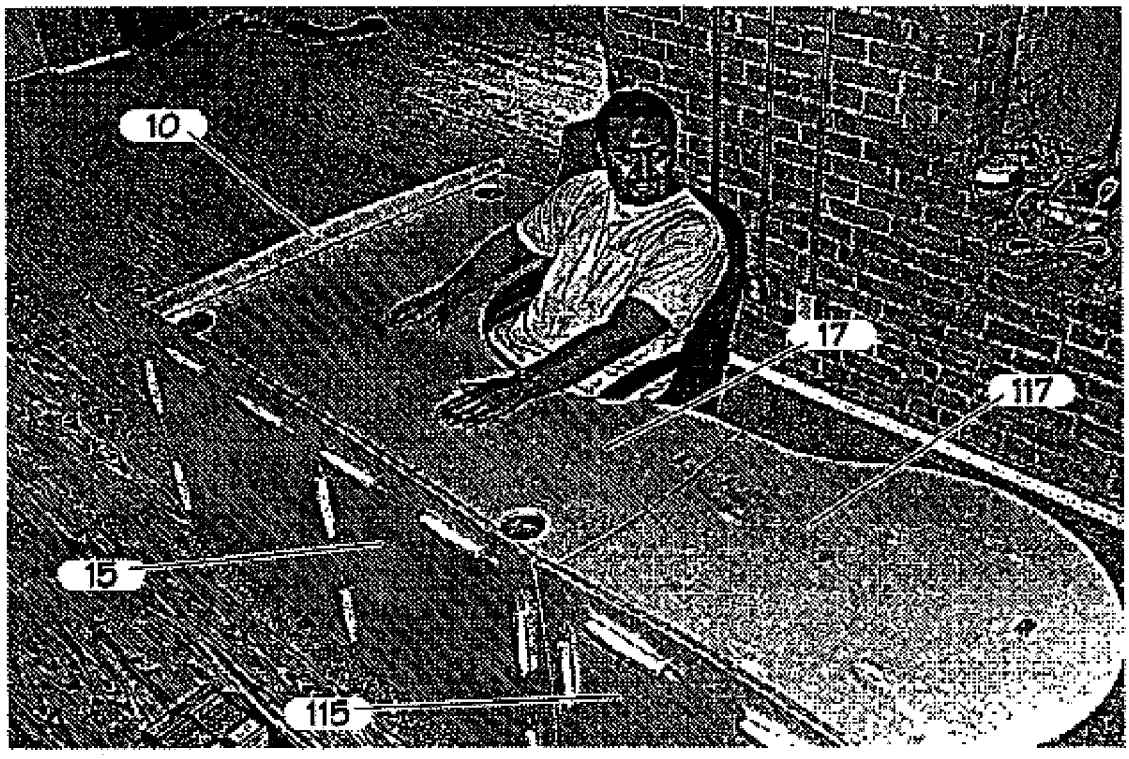
Figure 49:
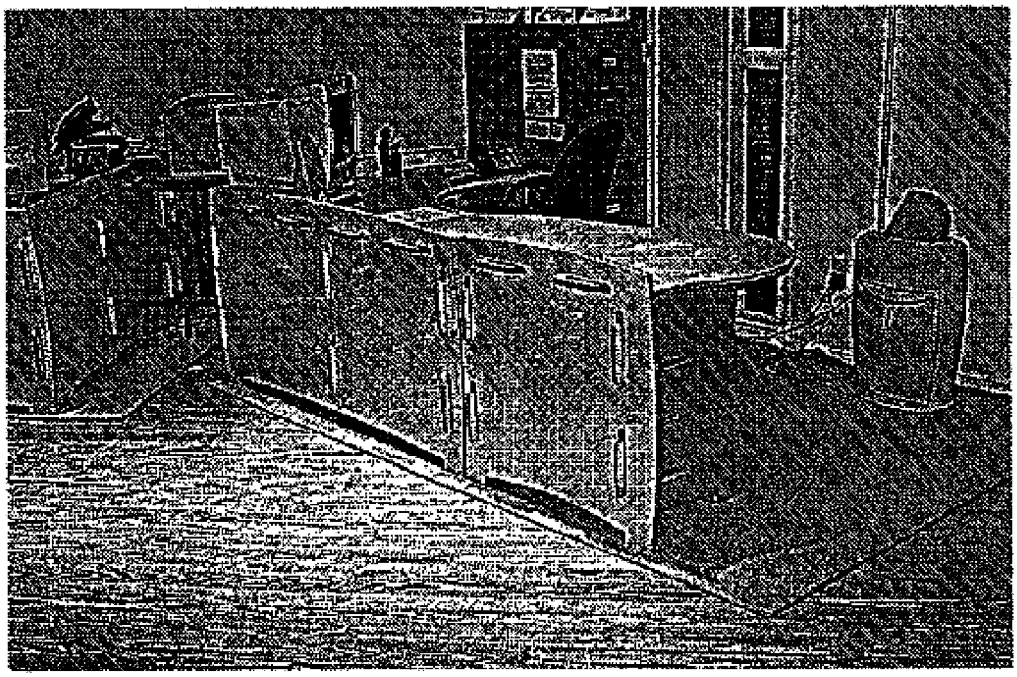
Figure 50:
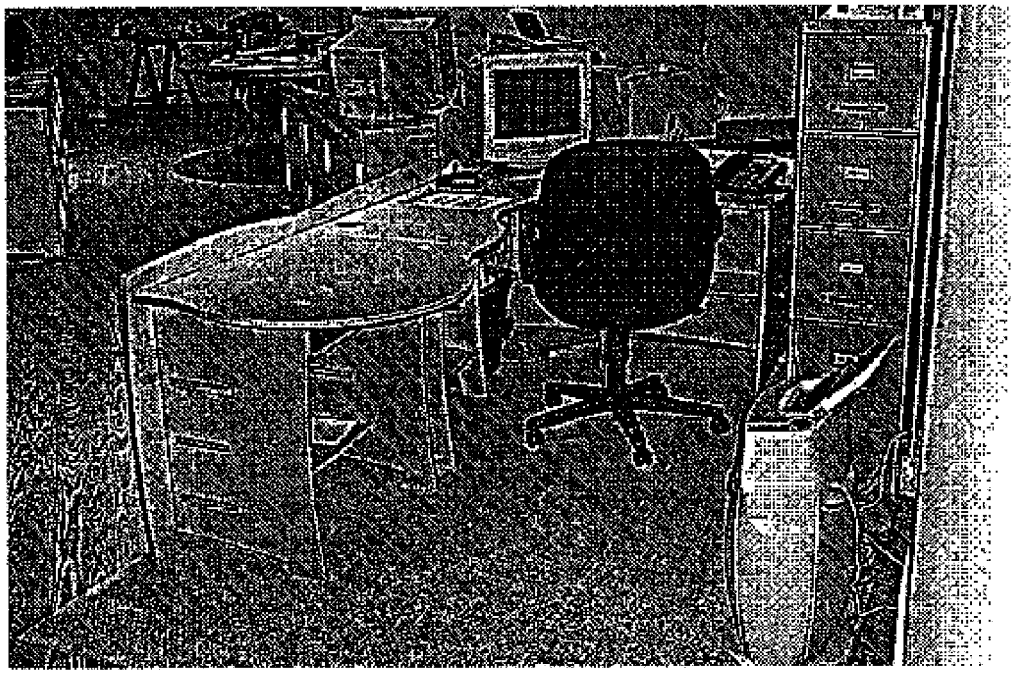

Referring now to FIGS. 37A, 37B, 38A, 38B, and 39 in the drawings, two embodiments of the interlocking assembly procedure of the desk of FIGS. 1–4 and the desk extension of FIGS. 5–9 are illustrated. In FIGS. 37A and 38A, a plurality of bowtie components 450 are interlockingly inserted in notches 37 of desk 11 and notches 335 of desk extension 311. In FIGS. 37B and 38B, a single bowtie component 460 is interlockingly inserted in notches 37 of desk 11 and notches 137 of desk extension 111. As is shown, the notch configuration is slightly different for the single bowtie component. However, in either case, bowtie components 450 or bowtie component 460 are hidden from view by desk work surface 17 and desk extension work surface 117 upon final assembly, as is shown in FIG. 39. Bowtie components 450 and 460 ensure that the assembled modular furniture is rigid and sturdy. Because the single bowtie 460 requires fewer pieces, the single bowtie procedure is the preferred coupling procedure.

Referring now to FIGS. 40–46 in the drawings, the interlocking assembly procedure for assembling a combined desk and desk extension in a left-hand configuration according to the present invention is illustrated. Modules can be assembled without tools. No fasteners or glue is required for assembly. Similar to a Burr puzzle, component pieces are assembled in a predetermined order. As pieces are assembled, a subsequent assembly step secures the pieces of the previous step. The final piece, typically the work surface, becomes the keystone which locks all of the previous pieces together in the final configuration.

First long vertical rear support 15 and short vertical rear support 10 are interconnected. Then, shelves 16 are installed between wide vertical side supports 12 and narrow vertical side supports 13, and coupling wide vertical side supports 12 and narrow vertical side supports 13 to short vertical rear support 10. Also, wide vertical side supports 12 and narrow vertical side supports 13, along with shelves 16 are coupled to long vertical rear support 15. Next, bowtie coupling components 450 or 460 are installed in notches 37. Then, desk work surface 17 is interlockingly installed by aligning vertical posts 27 with apertures 29 and lowering desk work surface 17 onto wide vertical side supports 12 and narrow vertical side supports 13, thereby completing the assembly of the desk module. Vertical posts 27 remain flush with desk work surface 17.

Next, desk extension 111 is assembled by interlockingly coupling the optional shelves 116 between wide vertical side supports 113, and coupling vertical side supports 113 to vertical rear support 115. Then, bowtie components 450 or 460 are connected to notches 137 of desk extension 111. Then, desk extension work surface 117 is interlockingly installed by aligning vertical posts 127 with apertures 129 and lowering desk extension work surface 117 onto vertical side supports 113, thereby completing the assembly of the desk extension module and the combined desk and desk extension unit. Work surfaces use gravity bias to keep modules securely locked together.

On desk 11, the desk work surface 17 may not be tilted up to provide clearance for vertical posts 27 on long and short vertical rear supports 15 and 10, because long and short vertical rear supports 15 and 10 are out-of-plane with one another. This out-of-plane orientation requires that desk work surface 17 be moved in a planar motion only when tabs 23*a* and 23*b* engage slots 25*a* and 25*b* in long and short vertical rear supports 15 and 10. Desk work surface 17 must then be flexed marginally to provide clearance for vertical posts 27 until desk work surface 17 reaches the installed position. At that point, the flexure of desk work surface 17 may be relaxed, allowing vertical posts 27 to protrude into apertures 29, locking desk work surface 17 into place.

Referring now to FIGS. 47–50 in the drawings, the assembled left-hand configured desk and desk extension of FIGS. 40–46 is illustrated. As is shown, office equipment can be arranged in a variety of locations, and the associated wires and cables can be fed through the provided apertures and hidden from sight. This entire assembly procedure can be performed by one person completely without tools, fasteners, or glue of any kind. Disassembly is performed just as quickly and easily by performing the above steps in the reverse order. It should be understood that the modular furniture system of the present invention allows different combinations of furniture to be assembled. All surfaces securely interlock without any hardware, yet are easily released and disassembled by hand.

All component pieces, including work surfaces and vertical supports, are reversible. Because each component is finished on both sides of the planar material from which they are manufactured, many different configurations are possible from the same set of components. This allows the design of asymmetrical modules that may still be used in either left-hand or right-hand configurations. During assembly, the user can choose to make a left-hand or right-hand module by positioning the component pieces in the proper orientation. This allows for maximum versatility by adapting to changing office environments. A user may simply disassemble a module and reassemble it in a different configuration to meet the changing needs. This reversibility simplifies the future design of additional components because a single design can adapt to either left-hand or right-hand configurations of existing components and modules.

Both symmetrical and asymmetrical designs are possible. Asymmetrical designs allow for maximum utilization of raw material. Because all parts are made of the same planar material, it is possible to interlock items of different shapes on the same sheet of raw material to achieve maximum material yield. Asymmetrical designs allow for greater versatility in meeting the needs of various office environments by providing a greater variety of unique configurations than do symmetrical designs.

The modular furniture system of the present invention provides for modular, expandable systems. Individual modules may be securely locked together. Slots provided in vertical supports allow adjacent modules to be interlocked without requiring tools or additional hardware.

For these reasons, the system of the present invention is well suited for small businesses or home office applications, where budgets and space may be limited. In particular, the modular furniture system of the present invention is ideal for contemporary small businesses, such as Internet "start-ups." Who frequently undergo personnel changes and reorganizations, where employees move their cubicles from one area of the office to another.

Figure 51:
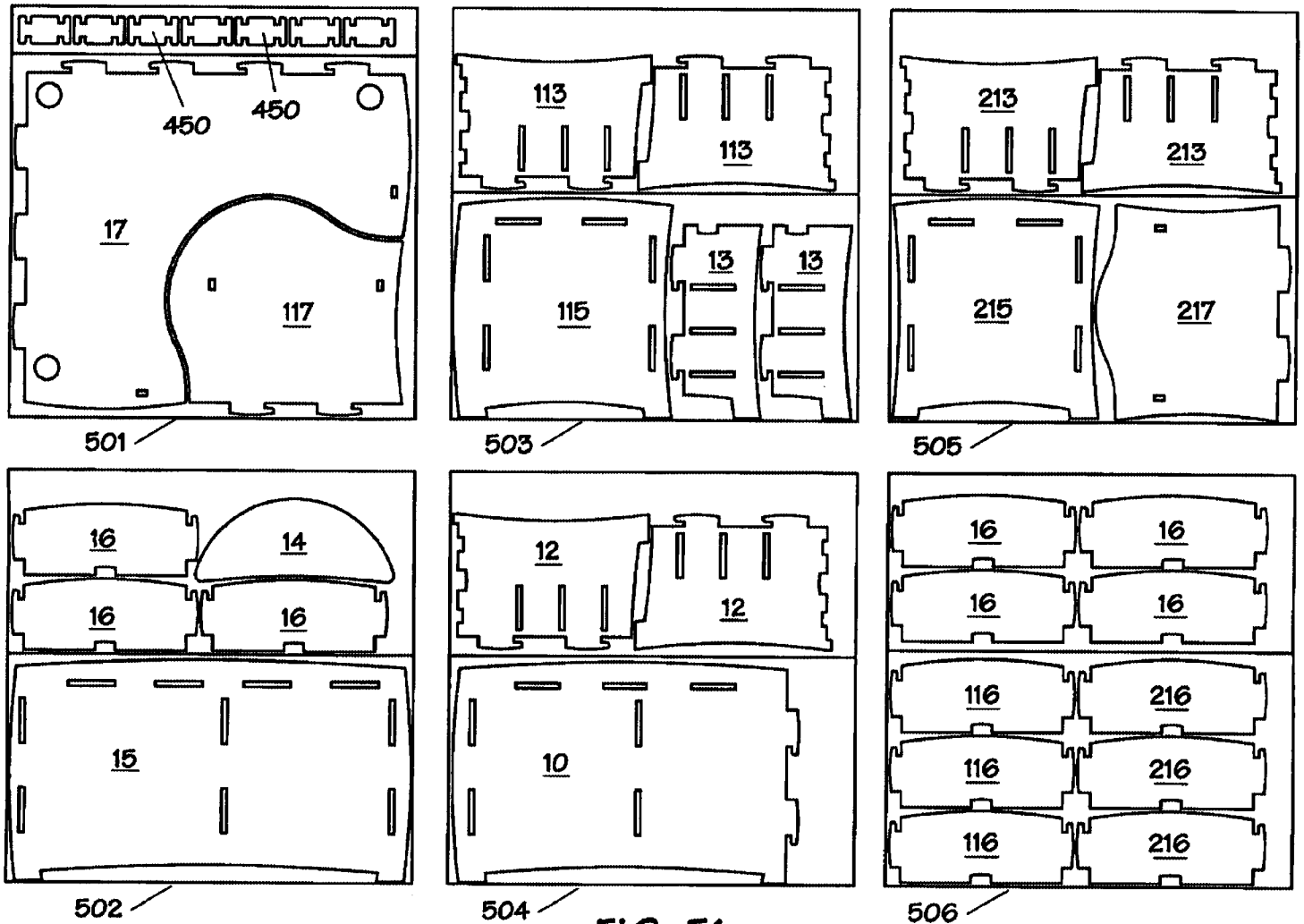
FIG. 51 is a top plan view of layouts of various furniture components on planar pieces of material according to the modular furniture system of the present invention.
Figure 52:
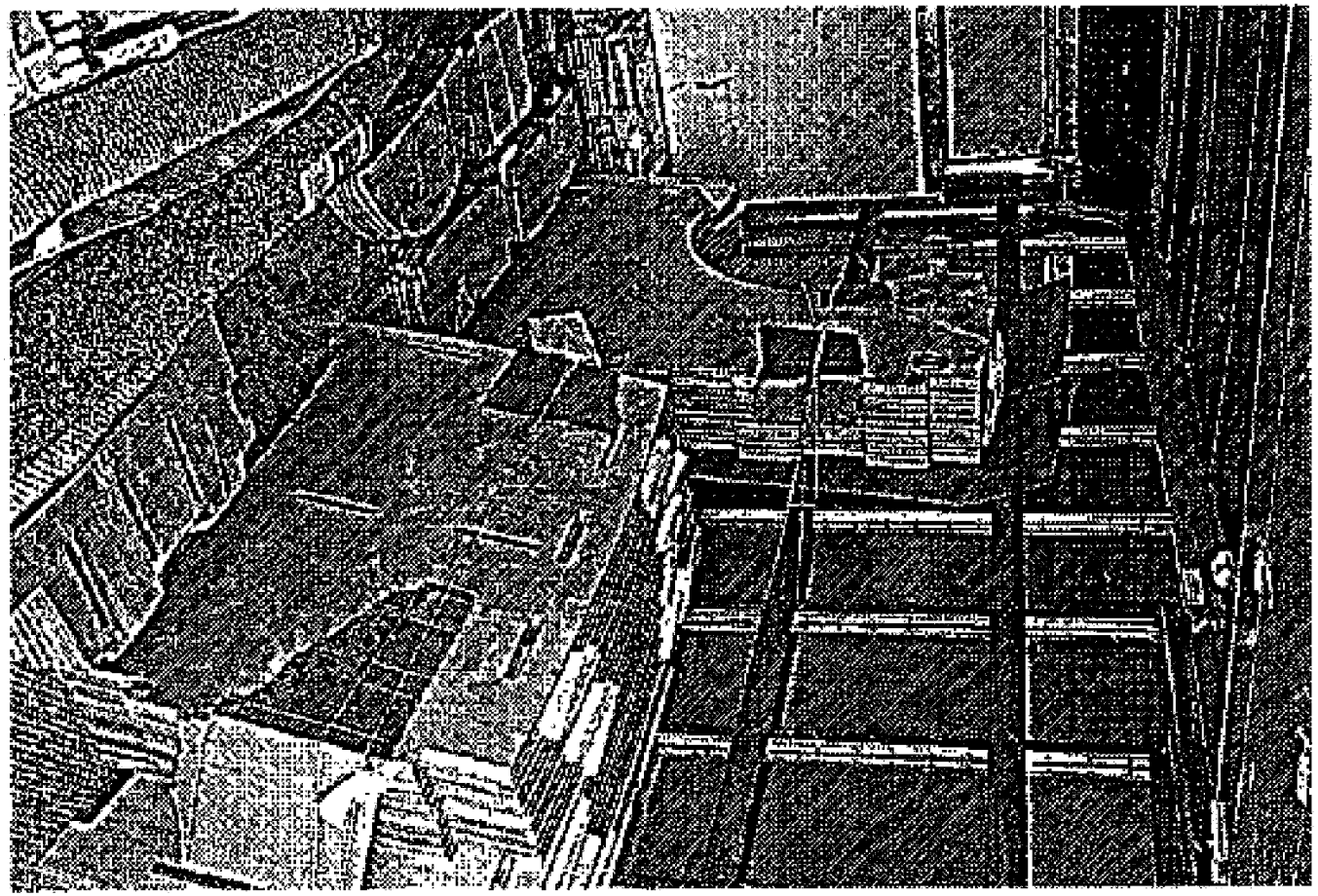
FIGS. 52 and 53 illustrate the stacking and storage capabilities of the modular furniture system of the present invention.
Figure 53:
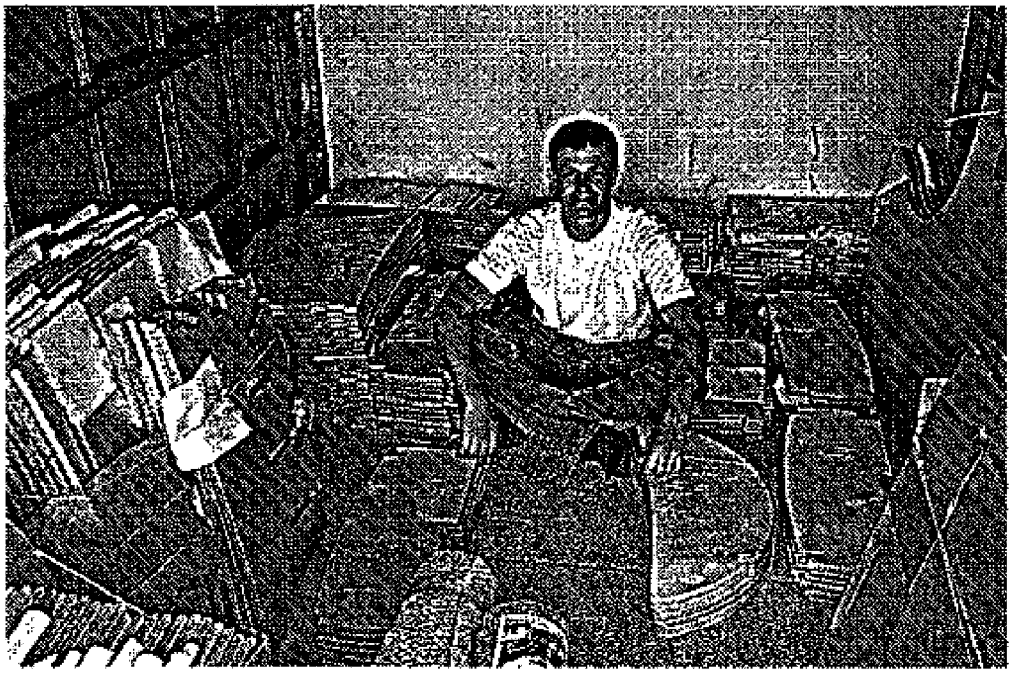

Referring now to FIG. 51 in the drawings, computer numerical control router pattern layouts for all of the required component pieces of desk 11, desk extension 111, and desk bridge 211 on 60-inch by 60-inch material are illustrated. A plurality of planar work pieces 501, 502, 503, 504, 505, and 506 are illustrated. The components of the present invention are preferably fabricated entirely from planar material of uniform thickness. This increases the choices of available and suitable construction materials. In addition, this minimizes the number of different machining processes required for manufacture. All component pieces may be manufactured using the same machining processes. On each work piece, 501, 502, 503, 504, 505, and 506, typical layouts for cutting the components of the present invention are shown. Such layouts ensure that material is efficiently used to manufacture the components of the present invention. This feature has the following advantages: (1) no post-machining assembly is performed, so the amount of material handling and number of required machining operations is minimized, reducing the total cost of manufacture; (2) final components can be produced from raw material in one machining step; (3) the planar design makes machining very suitable to two-axis machining processes such as computer-numerical-control (CNC) routers; (4) flat pieces may be packed and shipped in a flat configuration which minimizes the total size of the shipping package. This packaging allows shipping using normal mail carriers instead of freight carriers (see FIG. 52 and 53); and (5) flat pieces allow for more compact storage by the user before assembly or after disassembly. It should be understood that other layouts may be used.

Although the present invention is shown in a limited number of forms, it is not limited to just these forms, but is amenable to various changes and modifications without departing from the spirit thereof.

I claim:

1. A modular furniture unit, comprising:

(a) at least one substantially vertical back component having at least one of:
  (1) at least one slot; and/or
  (2) at least one tab;

(b) at least one substantially vertical support component having at least one of:
  (1) at least one slot; and/or
  (2) at least one tab;

(c) at least one substantially horizontal support surface having at least one of:
  (1) at least one slot; and/or
  (2) at least one tab;

(d) wherein said at least one substantially vertical back component and said at least one substantially vertical support component are interconnected by an action defined by the following steps:
  (1) at least one tab on a first component is inserted into a corresponding slot on a second component, along a first direction; and
  (2) said first component and said second component are moved relative to one another in a second direction which is non-parallel to said first direction;

(e) wherein all components are interconnected to one another through a series of sequential actions;

(f) wherein said series of sequential actions define a forcing function which ensures rigidity in said modular furniture unit after assembly is completed.

2. A modular furniture unit according to claim 1, further comprising:

(g) wherein said series of sequential actions minimize the number of components which must be aligned and interconnected at any action during assembly.

3. A modular furniture unit according to claim 1, further comprising:

(g) wherein said one substantially vertical support component comprises two substantial vertical support components; and (h) at least one substantially horizontal shelf component which interconnects between two substantially vertical support components, and, when assembly is completed, serves as a triangulating component which braces against movement of said two substantially vertical support components.

4. A modular furniture unit according to claim 1, further comprising:

(g) wherein locating one of said at least one substantially horizontal support surfaces is the final step of said series of sequential actions, which locks all components together.

5. A modular furniture unit according to claim 1, further comprising:

(g) wherein each of said series of sequential actions serves to limit movement along said second direction of components previously assembled.

6. A modular furniture unit according to claim 1, further comprising:

(g) wherein subsequent ones of said series of sequential actions prevent disassembly of components interconnected in previous ones of said series of sequential actions.

7. A modular furniture unit, comprising:

(a) at least one substantially vertical back component having at least one of:
  (1) at least one slot; and/or
  (2) at least one tab;

(b) at least one substantially vertical support component having at least one of:
  (1) at least one slot; and/or
  (2) at least one tab;

(c) at least one substantially horizontal support surface having at least one of:
  (1) at least one slot; and/or
  (2) at least one tab;

(d) wherein said at least one substantially vertical back component and said at least one substantially vertical support component are interconnected an action defined by the following steps:
  (1) at least one tab on a first component is inserted into a corresponding slot on a second component, along a first direction; and (2) said first component and said second component are moved relative to one another in a second direction which is non-parallel to said first direction;

(e) wherein said at least one substantially vertical back component includes at least one slot;

(f) wherein said at least one substantially vertical support member includes at least one tab;

(g) wherein said at least one tab of said at least one substantially vertical support component interconnects with said at least one slot of said at least one substantially vertical back component.

8. A modular furniture unit according to claim 7:

(h) wherein said at least one substantially vertical back component includes side edges;

(i) wherein said side edges may be formed into any shape.

9. A modular furniture unit according to claim 8:

(j) wherein each of said side edges define mating shapes permitting said modular furniture unit to be in abutment with another substantially vertical back component of another unit of modular furniture.

10. A modular furniture unit according to claim 9:

(k) wherein at least two vertical back components are located side-by-side to form a continuous surface.

11. A modular furniture unit, comprising:

(a) at least one substantially vertical back component having at least one of:
(1) at least one slot; and/or
(2) at least one tab;

(b) at least one substantially vertical support component having at least one of:
(1) at least one slot; and/or
(2) at least one tab;

(c) at least one substantially horizontal support surface having at least one of:
(1) at least one slot; and/or
(2) at least one tab;

(d) wherein said at least one substantially vertical back component and said at least one substantially vertical support component are interconnected an action defined by the following steps:
(1) at least one tab on a first component is inserted into a corresponding slot on a second component, along a first direction; and
(2) said first component and said second component are moved relative to one another in a second direction which is nonparallel to said first direction;

(e) wherein one of said at least one substantially horizontal support surfaces is a work surface which includes side edges; and (f) wherein said side edges may be formed into any shape.

12. A modular furniture unit according to claim 11, further comprising:

(g) wherein said side edges define mating shapes permitting said modular furniture unit to be in abutment with another work surface of another unit of modular furniture to define a continuous work surface.

13. A modular furniture unit according to claim 12, further comprising:

(h) wherein said work surface includes a front edge; and (i) wherein said front edge may be formed into any shape.

14. A modular furniture unit according to claim 11, further comprising:

(g) said work surface sits atop said at least one substantially vertical support component; and (h) wherein a load path is substantially through said at least one substantially vertical support component.

15. A modular furniture unit according to claim 11, further comprising:

(g) wherein locating one of said at least one substantially horizontal support surfaces is the final step of a series of sequential actions, which locks said at least one substantial vertical support component in place, by forcing said at least one substantially vertical support component into a final resting position.

16. A modular furniture unit, comprising:

(a) at least one substantially vertical back component having at least one of:
(1) at least one slot; and/or
(2) at least one tab;

(b) at least one substantially vertical support component having at least one of:
(1) at least one slot; and/or
(2) at least one tab;

(c) at least one substantially horizontal support surface having at least one of:
(1) at least one slot; and/or
(2) at least one tab;

(d) wherein said at least one substantially vertical back component and said at least one substantially vertical support component are interconnected by an action defined by the following steps:
(1) at least one tab on a first component is inserted into a corresponding slot on a second component, along a first direction; and
(2) said first component and said second component are moved relative to one another in a second direction which is non-parallel to said first direction;

(e) wherein said modular furniture unit may be assembled into one of a plurality of final configurations;

(f) wherein each of said plurality of final configurations is determined by at least one of:
(1) selecting an upward facing side of said planar work surface; and/or
(2) selecting the location of said at least one substantially vertical support component relative to said at least one substantially vertical back component; and/or
(3) selecting an outward facing side of said at least one vertical back component; and/or
(4) selecting a location for the coupling of other components, such as shelf components, relative to said at least one substantially vertical support component.

* * * * *